US005483127A

United States Patent [19]

Widmayer et al.

[11] Patent Number: 5,483,127

[45] Date of Patent: Jan. 9, 1996

[54] VARIABLE ARC ELECTRONIC BALLAST WITH CONTINUOUS CATHODE HEATING

[75] Inventors: Don. F. Widmayer, Bethesda; Alex W. Chiu, Rockville, all of Md.

[73] Assignee: Don Widmayer & Associates, Inc., Bethesda, Md.

[21] Appl. No.: 183,368

[22] Filed: Jan. 19, 1994

[51] Int. Cl.[6] ..... H05B 37/02

[52] U.S. Cl. ..... 315/307; 315/95; 315/DIG. 7; 315/114; 315/118; 315/100

[58] Field of Search ..... 315/95, 101, 102, 315/105, 106, 114, 118, 307, DIG. 7, 100, 244

[56] References Cited

U.S. PATENT DOCUMENTS

| | | | |
|---|---|---|---|
| 3,567,995 | 3/1971 | Lauritzen | 315/106 |
| 3,659,147 | 4/1972 | Widmayer | 315/107 |
| 4,253,048 | 2/1981 | Osako | 315/106 |
| 4,277,728 | 7/1981 | Stevens | 315/291 |
| 4,399,391 | 8/1983 | Hammer et al. | 315/106 |
| 4,484,107 | 11/1984 | Kaneda | 315/244 |
| 4,682,080 | 7/1987 | Ogawa et al. | 315/106 |
| 4,847,537 | 7/1989 | Ueda et al. | 315/244 |
| 5,179,326 | 1/1993 | Nilssen | 315/106 |
| 5,220,250 | 6/1993 | Szuba | 315/307 |

*Primary Examiner*—Robert J. Pascal
*Assistant Examiner*—Darius Gambino
*Attorney, Agent, or Firm*—Larson and Taylor

[57] ABSTRACT

A fluorescent lighting control system providing automatic and/or manual adjustability of the arc current(s) in one or more fluorescent lamps to permit operation of the lamps at less than rated wattage, and its concomitant luminous flux, in interior building spaces where full light output of the installed lamp(s) is rarely required particularly when daylight components are present. The goal(s) of this invention is to provide means to reduce wasteful electrical consumption in buildings and thereby reduce operating costs and gain the attendant benefit of dampening the increasing need for more electrical generation with its concomitant environmental pollution problem.

17 Claims, 15 Drawing Sheets

VARIABLE ARC ELECTRONIC BALLAST WITH CONTINUOUS CATHODE HEATING

II. FIELD OF THE INVENTION

The field of invention relates to control of fluorescent lighting in commercial buildings. More particularly, to its ability to vary the arc current hence, "variable-arc", flowing through the fluorescent lamps utilized in buildings supplied with three phase power, with its inherent continuous, non-varying (when loads are balanced) power flow to the lighting system by making provision for either automatic or manual adjustment of the fluorescent lamps' arc current as a means to reduce the luminous flux output of the fluorescent lamps' light level, with a concomitant saving in electrical energy, in areas where the maximum luminous flux output of an electrically energized fluorescent luminaire is not necessary.

III. BACKGROUND OF THE INVENTION

In 1848, a Yorkshireman, Joseph Swan was the first credited inventor of the an electrically operated incandescent lamp. Swan's early lamps provided little luminous flux output, were short lived, and were operated from low voltage Direct current (DC) galvanic (i.e., electrochemical) cell source of electrical power, thus requiring a relatively high current for any appreciable power delivered to the lamp. This relatively high current required the power source to be co-located with the lamp or unacceptable transmission losses, due to the finite conductivity of copper, would be incurred. Even at that time copper was recognized, as the most economic electrical conduction material. Due to this "line loss" penalty ($I^2R$ losses of the copper conductors) it was not practical to transmit low voltage power over significant distances. Hence, Swan's early incandescent lamp had limited application since co-location of the lamp and power source was mandatory. However, the Swan low voltage, high current, co-located power source concept for artificial illumination survives today in flashlights, many transport vehicle lighting systems (particularly automotive vehicles) and other applications.

In the 1870's Thomas Alva Edison became the foremost of the many rivals to Swan in the race to improve electric lighting via incandescent lamps. The problem was how could the electric light be effectively "divided", where the most effective source was the free-air carbon arc. The aforesaid limitation of low voltage incandescent lighting meant that it was necessary to have the power source almost co-located with each lamp in a building. The need was to have lighting in different rooms or areas driven from a remote power source but not suffer the relatively massive $I^2R$ line losses associated with low voltage consumption devices. This became known as the "division of light" problem and it was soon recognized that electric power could be more efficiently distributed at higher voltage, than usually associated with galvanic cell sources. A given amount of power could be transmitted with considerably less conduction losses inherent in copper conductors if higher voltage could be employed. For example, if an early 20 watt, 5 Volt Swan type of lamp existed, it would require 4 Amperes of electrical current. If a 20 watt, 100 volt lamp existed it would require only 0.2 Amperes of current. Thus, if higher voltage lamps could be developed, the transmission losses could be reduced to the point where the electric power source could be remotely located at great distance from the consuming devices.

By 1879 Swan had developed an approximation to the requirement. Edison, while working on the improvement of the then DC generators (at that time they were called dynamos which were used for free-air carbon arc lighting ) contemplated their use in a centralized power generation and distribution system for lighting. Further, Edison recognized the need for a high voltage, low current lamp so a central power generating station could be used for incandescent lighting. In 1878 Edison began to develop incandescent lamps beyond the limitations of the Swan lamps of the time. Late in 1879 he discovered that a carbon filament remained stable in vacuo. This discovery led him to a viable "high resistance", i.e. 100 Ohms or so, filamentary type lamp. Thus, the concept of using a central generation of higher voltage DC power and distributing electric power by copper wire to remote locations to solve the "division-of-light" problem, became widely recognized as Edison's contribution. However, it is not widely understood that Edison can be described as one, if not the first system engineer for his concept of integrating the electrical generation, distribution, and utilization elements to get a consistent set of requirements for each element to optimize the total System!.

In September 1882 Edison, using steam engine driven electrical machines to generate DC electric power, opened the first commercial central power generating station on Pearl Street in New York City. It had 85 customers and 400 lamps on the two wire feeder-and-main system. Later it was converted to the famous Edison three wire system consisting of a positive potential line, and equal but negative potential line and a neutral line, usually at ground potential. The DC power was distributed and was continuous and non-varying. The alternating current (AC) power that dominates the world today was little more than an electrical curiosity at that time. In 1889 Edison's companies, including his electric light company, and the Sprague Electric Railway Company, merged to become the Edison General Electric Company and later merged with Thomson-Houston Electric Company to become the General Electric Company (GE) which we know today.

Another inventor, circa Edison's time, was Nikola Tesla, a Croatian emigre to the US. Early in his career he worked for Edison redesigning DC dynamos in New York City. After being turned down by Edison for a requested raise of his salary from $18.00 to $25.00 per month, Tesla offered to sell his inventions to Edison for $50,000. Edison jokingly rejected Tesla's offer, who then resigned and in 1887 formed his own company to exploit one of his conceived inventions. That invention was, and remains today, one of the truly great inventions of all time, i.e., the conceptual discovery of the rotating magnetic field and the adaptation of it to his polyphase induction motor. Further, it provided means for generating polyphase AC power which had the salient property of being continuous and non-varying, just like DC. This work led to a series of patents between 1888 and 1896 which were acquired by the entrepreneur George Westinghouse, founder of today's Westinghouse Electric Corporation. Today almost all of the world's power is generated, transmitted, and distributed by some form of the Tesla polyphase system and where applicable, the generated electrical power is turned back into mechanical energy by updated versions of the motors originally covered by his patents. Tesla was never widely recognized in the US for his outstanding inventive contributions due to his eccentricities. Some referred to him as the "Mad Croatian", Edison called him "the poet of Science" and thought him to be impractical.

However, Tesla's patents, which Edison declined to buy, were purchased by Westinghouse and became the cornerstone of Westinghouse's design and 1894 inauguration of the Niagara Falls Polyphase AC Hydroelectric plant, which soon changed the gas lighting era in cities to AC electric lighting and all but ended the celebrated war between Tesla's, i.e., Westinghouse's AC system and Edison's, DC system. A statue of Nikola Tesla stands on Goat Island, an island located in the Niagara river at the precipice of Niagara Falls, in recognition of his contribution. The continuing success of the Niagara Falls Hydroelectric plant which used the Tesla system was victorious and ended the so-called "AC vs DC war" in favor of AC. During that period Edison, whose lighting patents had been acquired by General Electric, stated that AC electric power was not commercially practical, and furthermore dangerous,.and he refused to adopt it. Nevertheless, with George Westinghouse's advocacy, the Tesla AC system made General Electric's DC system obsolete by the turn of the century. The economic value of the Tesla and Edison patents caused them to be the focus of animosity and litigation. Westinghouse and General Electric cooperated in an an electric manufacturing duopoly which continued at least until the passage and implementation of the Clayton Antitrust Act in 1911 and the later formation of RCA during World War I which combined to blunt the duopoly's control of electric and radio patents. One Tesla radio patent case continued until 1945 when the Supreme Court belatedly reversed over a quarter of a century of lower court rulings in favor of Tesla and against Marconi Wireless, by then a part of RCA.

The ability to generate polyphase AC power gave the world a practical source of continuous, non-varying electrical power, just as good as DC power. The availability of economical AC power led to the use of large polyphase induction motors to supply mechanical power to industry without the commutation (switching) problems of DC machinery. Furthermore AC power had the advantage of being able to have its voltage transformed to higher or lower voltages. Typically, AC power is simultaniously generated as three-time displaced single phases, i.e., poly phase. Each of the three phases alternates between positive and negative half cycles 60 times each second (50 Hertz in some parts of the world). It is then distributed as polyphase power until the aggregation of a consumer's electrical load is relatively small. When that occurs the supplier, i.e., the electric utility company, will branch off at an appropriate point within their electrical distribution system, one of the three phases to supply that consumer, i.e., residence, small group of residences, or smaller buildings. Larger commercial buildings will receive all three phases of the polyphase distributed power. Then the consumer in turn will deliver polyphase power to the larger building loads, i.e., large motors, such as the HVAC sub-system and to the buildings electrical distribution panels. From the electrical distribution panels, the power is usually distributed as single phase power to the smaller load devices. Since the building electrical lighting and appliance loads consist of widely distributed individual devices, they are generally designed to operate with single phase AC power. Hence, single phase branch circuits distribute the power to accommodate these single phase consumption devices. These single phase circuits generally have three wires, the "line" which is "hot", the neutral line which is "cold", and a saftey ground conductor. Care must be taken to insure that the electrical loads powered by the single phase branch circuits are more or less equally divided between the three different phases available so as not to vitiate the beneficial purpose of polyphase power, i.e., continuous, non varying power flow.

At the turn of this century incandescent lighting began to replace gas light and became the lighting of choice in commercial buildings until the 1940's when gas discharge lamps, based on Hg vapor excited, fluorescent material for visable light was perfected as an alternative (Westinghouse Electric first demonstrated what portended to be a commercially useful fluorescent gas discharge lamp (GDL), at the 1938 Chicago Worlds Fair). This new lamp had to have an auxiliary device to first cause lamp arc ignition and after ignition occurred, to limit the amplitude of the arc current since by itself the fluorescent lamp had no inherent current limiting mechanism when operated from a voltage source. Without an auxiliary device to stablize or limit the arc current, the lamp's arc would exceed its current rating and damage everything involved. In North and South America these auxiliaries have been combined into a single device called a ballast which provides means for lamp arc ignition, current limiting, and in some cases a necessary supply voltage transformation to accommodate different lamp lengths. The current limiting, i.e., ballast function, effectively establishes the arc current to a maximum fixed-arc level.

Despite the need for both a lamp and ballast, with the latter's attendant higher first cost, the fluorescent lamp soon began to replace the incandescent lamp in most commercial and industrial lighting applications. It had a much longer life, resulting in substantially reduced maintenance costs. Further, due to its physical linear nature it is was and remains a more distributive light.source, as opposed to the peak-valley or "spot" characteristic of the point source incandescent lamp it replaced. Still further, just as the incandescent lamp was a more efficient light source than the gas jet it replaced, the fluorescent lamp was two to three times more efficient than the incandescent lamp, in terms of luminous flux per unit of electric power consumed. However, much of the electric energy that could have been saved was lost due to an industry-driven high intensity lighting marketing trend which, in today's energy conservation environment, is considered beyond the need of human use.

By the 1960s the fluorescent lamp was ubiquitous in building lighting with more efficient phosphors and a variety of starting methods, i.e., pre-heat, rapid-start, or instant-start, had been developed. Advances in lamp electrode technology and phosphor coatings made the fluorescent lamp even more efficient and lamp life continued to increase. These fluorescent lamp improvements combined with inexpensive energy, brought about the unnecessary high illuminance lighting of over 100 foot candles (lumens per foot$^2$) or over 1000 Lux (lumens per Meter$^2$) that became common place in the 1960s and 70s.. Then came the infamous Oil Embargo of the 1970's, causing energy costs to spiral, and energy conservation came into vogue. It had been recognized that over half of the lighting energy consumed in commercial buildings was a costly waste of electric energy and the concomitant money.

However, the trend of wasteful overlighting had to continued until the lighting industry could design new replacement products like three lamp luminaires to replace four lamp luminaires and reduced wattage lamps, et al, to bring about less lighting electric power consumption while the industry attempted to increase market share dollar volumes. Typical of the pricing strategies is the tri-phosphor reduced wattage fluorescent lamp selling for three and four times the price of the industry standard, low cost, cool white, 40 watt F40 fluorescent lamp, which by the wisdom lobbied into the 1992 Energy Act of Congress, is scheduled to be outlawed in 1994. While the number of the new tri-phosphor T-8 lamps sold may decline, due to the requirement for less light, their increased cost indicates that the lamp industry's sales volume will increase. Similarly, luminaire manufact-urers have developed new reduced lamp population, high cutoff angle, parabolic polished aluminum reflector surface luminaires which sell at a cost of two and three times as much as the former commodity level, white painted, 4 lamp, prismatic lens diffuser luminaire.

The third new major lighting related device, spauned by the energy conservation movement, is the so-called "electronic ballast" which provides a nominal fixed-arc current to the lamp(s). These electronic ballasts, with up to a nominal 20% increase in efficacy, sell at prices 2 to 4 times the cost of the conventional ballast that they are meant to replace, and they generally require DC power which requires the conversion of AC to DC.

Not surprisingly, some of these new, more expensive, products met with some sales resistance until the electric power utility companies began to grant subsidies (i.e. money rebates) to purchasers of these new lighting products. The rationale behind the rebate was that these new products would reduce electric demand. The electric power utilities discovered that where the Public Service Commissions might resist electric energy rate increases for building new electric power generating facilities, the same commission would often grant the same requested rate increase if the utility company would spend the rate increase proceeds on electric energy conservation programs like giving an end user a "rebate" if a building was retrofited with the new reduced energy consuming lamps, luminaires and/or electronic ballasts. Some utilities discovered they could make more money by selling less through these giveaway programs. Thus, instead of the building owners paying for the new equipment the rate- paying public at large would pay for the retrofiting of these new products. This strategy was abetted, adopted and sold by some utility companies based on the hope that it would be able to delay the construction of new generating plants which use scarce resources and emit both thermal and material pollution.

Of anecdotal note, had modern day electronic technology been available during the DC AC war between Edison and Tesla (and their respective sponsors, General Electric and Westinghouse) during the 1880s–1890s, Westinghouse's AC approach might not have been the total victor. For example, in today's world and for a number of reasons, AC is converted to DC for long distance electric power transmission. A further example is today's increasing need for DC power is the widespread and increasing use of DC motors, from large elevator motors to small printer motors where again, AC has to be converted into DC. Still further, state of the art fluorescent lamp lighting, one of the largest consuming segments of electric energy, is now converting utility delivered AC power into DC before it is inverted back into higher frequency AC power. Had the Edisons and Teslas of their day only known what the future held, a split system, i.e., AC and DC, might have been developed to meet today's need for DC power. Converting AC to DC, while costly, is easily accomplished with todays technology. Converting polyphase AC into DC power (polyphase) is considerably less expensive single phase AC to DC. The conversion of single phase AC to DC is more expensive because in addition to the rectification of the AC into pulsating DC, energy storage elements are then required to convert the pulsating DC into an acceptable level of continuous, non-varying, DC power. These two methods of converting AC into DC as they apply to fluorescent GDL will be discussed in the summary and detail description sections below.

To date the lighting industry, including the electric power utility companies, in maintaining the use of fixed-arc current lamp operation have overlooked the energy saving strategy which dwarfs all other electric demand reducing strategies. The overlooked strategy, which offers more promise than the combined savings of the new, energy saving, lamps, fixed-arc electronic ballasts, and reduced population luminaries etc., is to operate the fluorescent lamp with an automatically adjusting variable-arc current. With fixed-arc current operation it is necessary to overlight at least by a factor of at least two to one for the following reasons.

First a building has to be overlit because the light output of a fluorescent lamp declines with its usage and/or lack of proper luminaire maintenance. The general rule applied to such lumen depreciation problems has been to overlight when lamps are new, with its concomitant waste of energy, in order to have enough light when lamps are aged, or, their light output degraded because of improper maintenance. Adopting this general rule of overlighting new lamps, leads to an average energy waste of at least 10 percent of the consumed electrical energy which can be saved if automatically adjusting variable-arc current lamp operation is adopted.

Secondly, as people age their visual acuity declines, e.g., the worker population in the fifties age group have less than half the visual acuity of the twenties age group. Thus buildings with fixed-arc lighting systems are designed to accommodate an older work population. The current standards established by the Illumination Engineering Society/American National Standards Institute (IES/ANSI) effectively state a lighting level of 200 Lux (nominally 20 foot candles) for general office work for a person under 40, and 300 Lux (nominally 30 foot candles) for a person between 40 to 55, and 500 Lux (nominally 50 foot candles) for the over 55 person. Since fixed-arc lighting precludes adjustment, buildings in general tend to light for the older age group. Therefore, age group related over-lighting causes at least a 30% energy waste which can be saved with variable-arc current lamp drive systems.

Third, fixed-arc current lghting also tends towards having uniform building lighting, hence public areas. i.e. corridors etc., which account for 10 to 15% of the building space, have several times more light than called for by the IES/ANSI standard of less than 10 foot candles in public spaces. This overlighting of public building spaces results in at least 5% of a building's overall lighting energy being wasted, which could be saved with variable-arc current lighting.

The fourth major lighting energy waste is that most building lighting systems in general are designed without regard for daylight other than its use as an additive light component to the fluorescent light. This overlighting strategy of not using daylight in lieu of fluorescent lighting, brought about by the rare need to use offices at night when no daylight is present, is totally wasteful in today's world. Variable-arc current lighting provides the "just right" amount of light at all times by automatically adjusting up or down as daylight increases or decreases, hence their is no longer any justification for overlighting. The total utilization of free daylight in modern "glass wall" buildings brings about an average overall building saving of electrical lighting energy of at least 30%.

Multiplying all the above described minimal energy saving factors, (5% due to the overlighting of corridors and public areas, 10% due to overlighting in order to have enough light when the lamps and luminaires are depreciated, 30% due to overlighting for worker population age group considerations and 30% due to failing to properly utilized free daylight), in lieu fluorescent lighting) together, i.e., (1 - 0.05) X (1 - 0.10) X (1 - 0.3) X (1 - 0.3) reduces the lighting to nominally 42% of the level required for fixed-arc lighting thus providing a potential reduction of 58% in the lighting energy consumed, and concomitant costs, if vari-able-arc lighting is utilized.

In addition, less lighing equates to less building heat load which the HVAC must dispose of, leading to even further savings, which are realized in particular during the summer months peak demand period(s). Further each office or building area can be lighted to meet the space, task, and/or an occupant's individual needs often leading to increased productivity, by being able to initially set the lamp's arc current to the proper night time lighting requirement and thereafter let the arc current automatically adjust and readjust whenever necessary, to maintain the just-right established lighting level. At anytime the building maintenance personnel can manually readjust the night time just right lighting level to accomodate the requirement if and when that space is reconfigured for other tasks or use. Hence, the building can have the just right level of light now and in the future, even when conditions vary.

Variable-arc current lighting has taken time to be develop and mature into reliable products because the fluorescent GDL is intrinsically a non-stable, highly non-linear both statically and dynamically, electronic device. Because of these characteristics, attempting to control the fluorescent GDL devices bring a host of "new" problems to electrical lighting never encountered with incandescent lighting. Many otherwise qualified companies and their engineers have attempted to develop variable-arc current control for fluorescent GDL devices but to date only a few have succeeded and fewer yet in a cost effective manner that meets the requirement of practical application.

When a fluorescent GDL is driven from a sinusoidal AC voltage source of power, the instantaneous power flow is by definition non-continuous, hence variable. If the single phase AC source were an ideal square wave current, power flow could conceivably be continuous and then ideal. Conversely, if during part of each AC half wave the voltage available is insufficient to sustain the lamp's arc, the GDL's plasma column will begin to de-ionize. These phenomena occur during each sinusoidal AC voltage half-cycle when the instantaneous voltage, impressed across the GDL, falls below a certain level. For example, a 40 Watt F40 T-12 fluorescent lamp requires a nominal instantaneous voltage of at least 100 volts between the lamp's two electrode pairs. Hence, if the nominal voltage applied to the lamp-ballast combination was 120 volts$_{rms}$, the voltage sine wave would vary from zero to nominally 170 volt peak and the arc discharge could not be sustained in that portion of a given cycle where the applied voltage is less than the 100 volt required to sustain the arc discharge. During the period(s) of time of the applied voltage sine wave, when the instantaneous voltage is below the arc sustaining level, the plasma column is de-ionizing and re-ionizing. When lamps are operated with 50/60 Hertz AC power, the deionization and re-ionization phenomena of the GDL might take two (2) milliseconds out of each nominally 10 (for 50 Hertz or 8.33 . . . for 60 Hertz) milliseconds out of each AC half wave time period. It has long been known that if the driving frequency is raised to greater than the natural relaxation osccilation frequency of the plasma, increased lamp efficacy results. One of the reasons for the increase in efficacy is that, the anode fall voltage (on symmetrical AC of any waveshape, a lamp electrode operates alternately as a cathode, then an anode, then a cathode etc. for equal time intervals) drops a significant amount of voltage at the lower frequencies. Further, when the GDL is operated above the natural relaxation frequency of the plasma, the interval of current reversal now becomes sufficiently short that (less than 500 microseconds or so) that the loss of electrical energy into the arc for repeated deionization-reionization is significantly lower. These two factors account for the vast majority of the observed increase in lamp efficacy (luminous flux per watt of arc electric power).

The wide spread recognition that operating the arc plasma at a higher frequency brings higher lamp efficacy and other benefits, coupled with advances in the semiconductor industry and ever increasing electrical energy costs has spawned a movement to convert the AC driven magnetic ballasts to electronic ballasts. However, the latter require a DC link voltage which then has to be inverted into relatively high frequency AC, by appropiate electronic switching devices in order to improve fluorescent GDL efficacy as an energy conserving strategy. Therefore, pioneer developers of "electronic" ballasts have to employ AC to DC and DC to AC power conversion techniques with the latter at selected operating frequencies well above the natural relaxation oscillation of the arc's plasma, voice band telephony, and the human aural hearing frequencies. The selected frequency is usually of the order of 20 KiloHertz and above to avoid magnetostriction generated acoustic noise. This is higher than necessary for efficacy enhancement but working at these higher frequencies guarantees avoidance of the inherent aforementioned de-ionization re-ionization losses and the nominal 10 to 15 volt drop due to the electrical phenomena at the anode electrode whenever a fluorescent GDL lamp is operating at an AC frequency significantly below the natural relaxation oscillation frequency of the plasma. The 20 kHz exceeds the need to eliminate the cathode fall voltage, acoustic "noise" and/or the generation of voice band telephone system interference.

When a fluorescent GDL is operated significantly above the natural plasma frequency, a nominally greater than 10% reduction in power is achieved for a given luminous flux output compared to the same GDL whose arc current is operated with 50–60 Hertz power with a non square wave arc current wave form, i,e., a waveform approaching a sine wave. Care must be taken to suppress unacceptable levels of electromagnetic interference (EMI), one of the elements of the growing problem of "electro-pollution", that might otherwise be conductively coupled to the line frequency AC power source. There are two aspects of electro-pollution to be concerned with; 1, the generation of low frequency current harmonics of the line current being returned to the AC power distribution system; and, 2. the induction fields which surround the lamps plus some actual radiation at higher frequencies due to harmonics of the frequency driving the the arc plasma and the conduction of same back into the power line.

Generally the approach taken in the design of "electronic ballasts" is to base their design on utilizing the three wires (i.e., line which is "hot", neutral which is "cold", and the safety ground) single phase AC power source (60 Hertz in North and South America and 50 Hertz in most of Europe and Asia) of a single phase AC power branch circuit generally feeding each fluorescent lamp luminaire. However these same three AC wires could be utilized as conductors for a three wire "Edison" DC branch circuit, i.e., a positive potential DC line, a negative potential DC line and a neutral at the ground potential. To branch off single phases of the polyphase power and convert each of those single phases into DC co-located at the consuming site isn't as inefficient as directly converting the polyphase AC power into DC power. In the single phase AC case, the AC must be rectified and then an energy store must be provided to filter the rectified pulsating DC into a non-varying DC power source to supply the DC to AC converter section of the "electronic ballast". This approach to DC creates additional power factor and harmonic current problems which can and must be resolved by more expensive filtering. In the conversion of polyphase power to DC, the power factor and current harmonic problems associated with the single phase case, are not present and further, very little energy storage is required. In either rectification case, the continuous DC power, i.e., the DC link must always be supplied to the DC to AC inverter section of the "electronic ballast" which converts the continuous DC Link power back into AC but at a higher frequency. When the GDL(s) are driven from a high frequency power source, the required current limiting element, i.e., the ballast (either a capacitor, or inductor or combination thereof, connected in series with each lamp or lamps) become relatively small compared with the elements required in 50/60 Hertz AC powered systems.

Prior art also teaches that there are at least three common methods to gain lamp arc ignition. The first is called "instant start" wherein the voltage, at the time it is applied to the lamp, is sufficiently high to cause field effect electron emission from the cathode surface, and thus provide the initial electron current carriers to start the arc flowing. Thereafter the necessary electron emission from the lamp's cathode(s) is achieved by thermionic electron emission caused by the arc heating the cathode(s) via the anode fall and the cathode fall phenonema.

The second commonly used method for lamp arc ignition is called "Pre-heat or SwitchStart" wherein a current temporarily flows in the cathode heating element causing thermionic electron emission from the cathode for arc ignition. These emitted electrons act as the current carriers for the lamp arc. Once the lamp arc ignites, the externally applied cathode heater current is terminated and the ability of the cathode to emit electrons is sustained only by the arc created heating via cathode and anode falls at the electrodes.

The third and perhaps the most widely used lamp ignition method in the North and South America continents is called "Rapid Start" ignition wherein the lamp electrodes are heated by an external source both before and after arc ignition occurs. It is well known that GDL lamps operated "Rapid Start" have a longer lamp life than lamps operated "Pre-heat" and lamps operated "Pre-heat" tend to have longer useful lives than lamps operated "Instant-Start". Hence the slightly higher cost of a rapid start ballast is offset by longer lamp life and the resulting reduced lamp maintenance costs.

So far this discussion has been limited to ballasts which operate its associated lamps with a fixed-arc which is the nominally accepted standard for most of today's fluorescent lighting. While fixed-arc lighting is efficient relative to incandescent lighting, a great deal of energy is wasted. The principal shortcomings of fixed-arc current lighting will now be discussed.

One energy wasteful shortcoming of "fixed arc" lighting is that the useful life of the phosphor coating on the inside wall of the fluorescent tube, is slowly shortened by the energetic UV photons causing molecular disassociation of the phosphor molecules and the metal emissions from the cathodes causing a thin layer of metal overcoat the phosphors, i.e., sometimes noticed near the lamp ends and called end darkening wears over time; thus the light output steadily declines. Further, and well within the useful life of a lamp, both the lamp and the reflecting and transmission surfaces of the lamp luminaire accumulates light absorbing dust causing a further diminution of the useful portion of the generated light. Both users and light system designers recognize and sometimes refer to these problems as the "lumen maintenance design factor". In order that the lighted space never reach an underlighted condition, lighting system designers select the only solution to this problem of fixed-arc lighting systems which is to overlight the space when lamps are new and luminaires are clean so there is still sufficient light remaining when lamp light output at the luminaires reach depreciated states. On average, the amount of overlighting, sometimes called the "lumen maintenance design factor", can be as much as 30%. This need for designed-in overlighting, results in an average electrical energy waste exceeding 10%.

This energy wasteful practice can be eliminated if the fixed arc could initially be adjusted to the "just-right" level and then have the arc plasma automatically adjust upward to maintain the initial luminous flux output of the luminaire and lamps lowers.

A second energy wasteful shortcoming of "fixed-arc" lighting relates to variations in visual acuity by different age groups. For example, the North America Illuminating Engineering Society (IES) has established guidelines which require upward lighting adjustments as much as 150% depending on the occupant age group and other factors. Since it is not practical to limit office occupants to younger age groups, buildings with "fixed-arc" office lighting levels must be designed accommodate the older age group worker population. In recognition of a person's visual acuity changing with age, the IES in their average weighting factor system (AWF) recommends higher light levels for older workers. For example purposes, IES lighting guidelines for category D (most often applied to general office work) calls for a lighting level of 200 Lux per square meter (nominally 20 foot candles, or lumens per square foot) if the task background reflectances are at least 70% and if the worker population is comprised of the under forty age group. If anyone in the working population is falls in the 40 to 55 age group that person(s) require 300 Lux, a 50% increase, and even more light for the yet older group age group and other factors. Thus buildings generally have to be overlit by at least 30% or more to include the liklyhood of older workers and thus avoid worker age discrimination. Variable-arc current lighting abolishes the need for age group compromised overlighting since the overlighting of the offices can be localized by it being lowered to the required "just right" level. Based on the assumption of an average office occupant age of 40 and offices comprise 80% of the building space, lighting energy savings of at least 20% can be realized with variable-arc current lighting.

The third and a major shortcoming of fixed-arc current lighting is that it does not utilize the free daylight contributions to sustain lighting in lieu of the costly electric lighting. The utilization of daylight contributions present in the majority of prime office space is left to the occupant getting up to turn the lights on when he needs the light and off when sufficient daylight is present and is noticed by an occupant. However in general the fluorescent luminaires are rarely turned off since overlighting is seldom noticed because when too much light is present a person's vision system simply adjusts by its iris constricting to limit the amount of light admitted to the vision system. Automatically adjusting variable-arc current lighting eliminates this waste by decreasing the arc current in relation to the amount of daylight entering each luminaire's area of illumination. Recorded tests with variable-arc current lighting indicate that the savings due to the daylight period of a day due to the roughly proportional reduction of the fluorescent lighting required, range from 30 to 64%. The majority of these savings occur when the sun is brightest and days are longer which usually corresponds with the peak summertime demand period when energy is often most costly and electric energy conservation most necessary and desirable. Daylight energy savings alone with variable-arc lighting will is estimated on average to reduce lighting energy consumption of the average building, at least 30%.

The fourth shortcoming of fixed-arc current lighting is its inability to vary background lighting levels hence, there is a tendency to select a general level of background lighting in office work areas capable of meeting all requirements. This approach leads to excess lighting in many areas. For example, the general office lighting level may be unsuitable for a CRT display of a personal computer or work station. Such improper lighting not only wastes energy but, can bring about glare problems with possible detrimental effects on work productivity. Variable-arc current lighting alleviates problems relating to task lighting in general by being able to adjust the background lighting level to the optimum level. Lacking building specifics, the ability to vary background lighting in terms of light energy savings is building and room geometry dependent. However, the ability to task light as required can be conservatively estimated to bring about at least a 10% energy savings.

Many other benefits flow from a changeover from fixed-arc lighting to variable-arc current lighting. Corridors with their longer duty cycles often account for up to 20% of the electrical lighting energy and often have the same 200, 300, and 500 Lux lighting level as offices despite the Illuminating Engineering Society (IES) and American National Standards Institute recommendations of 1/10 of the office lighting levels, i.e., 20, 30 and 50 Lux. Reduced electrical consumption also means less heat that the HVAC system must handle. All electrical lighting energy consumed for lighting purposes ultimately becomes heat which the building's HVAC system must handle. Of note, during the cold months when building heat is needed it is far more economical to generate the required heating BTU's from the building's heating system than by generating unnecessary lighting by-product BTUs. The above comments relate to the conservation of electrical energy through the adoption of variable-arc current lighting to eliminate totally unnecessary energy waste which is required in any building which utilize fixed-arc lighting. Still other benefits flow from eliminating the inherently wasteful practices discussed above, i.e., the economic benefits flowing to the building owner in that by substantially reducing electrical demand for lighting, e.g., a major New York building operating costs can be reduced by hundreds of thousands of dollars. Further, it helps the environment in the sense that each kWh of electrical energy saved means one less kWh has to be generated thus lessening the inherent thermal and particle pollution of land, air and water that electrical power generating plants brings about.

IV BRIEF DESCRIPTION OF THE FIGURES

FIG. 1. Variable Arc Fluorescent Gas Discharge Lamp Operation System (the top level Functional Block Diagram)

FIG. 2. Fluorescent Gas Discharge Lamp Control (Functional Block Diagram)

FIG. 3. Operating Frequency Bands vs Human Aural Relative Sensitivity

FIG. 4. Variable-Arc Operation Lamp Current Waveforms (Generic Form of Arc Converter Power Converter)

FIG. 5. Generic Half-Bridge Switching Converter (Functional Circuit Schematic)

FIG. 6. Half-Bridge Switching Inverter (Degenerate Form Functional Circuit Schematic)

FIG. 7. Switching Node Voltage Waveform (Half-Bridge switching Inverter Inductively Loaded)

FIG. 8. Central Power Converter (Circuit Schematic)

FIG. 9. Power Converter for Arc Current Drive (Generic Functional Block Diagram)

FIG. 10. Power Converter for Control and cathode heating Power

FIG. 11. Single Phase AC to DC Converter (Functional Block Diagram)

FIG. 12. Single Phase Variable-Arc Electronic Ballast (Functional Block Diagram)

FIG. 13. Variable-Arc Electronic Ballast for Polyphase AC (Functional Block Diagram)

FIG. 14. Single Phase Variable Arc Electronic Ballast (Degenerate Form of Inverter (Simplified Circuit Schematic Diagram)

FIG. 15. Detailed Schematic of Single Phase Variable-Arc Electronic Ballast (Preferred Embodiment)

V SUMMARY OF INVENTION

In further accord with the previously described background section, the benefits to be derived from adopting variable-arc lighting in commercial and institutional buildings are substantial in terms of lowering operating costs, conserving scarce energy resources, and the lessening of environmental pollution caused by electrical generation. The disclosed invention addresses the cost-effective attainment of these objectives by exploiting a variety of electrical circuit and optical techniques in a new and novel manner.

More specifically this invention provides society with the means to save billions of kWh of electrical energy consumption and therefore not having to generate as much electrical energy as is presently required for the provisioning of light in commercial and institutional buildings through the use of fixed-arc fluorescent GDL lighting. The goals of the invention are accomplished by providing a more efficient commercial building lighting system that eliminates the requirement to overlight buildings whenever fixed-arc lighting is employed. Further this invention has the option of providing a more efficient method of distributing the electrical energy in the branch circuits feeding the luminaires, which in so using solves the building problem of lighting load balancing by making lighting load balancing an inherent feature of this new distribution methodology. With either this new approach for electrical power distribution or continuing with the present day conventional lighting power distribution to the lighting luminaires, variable-arc current lighting can totally eliminate the electrical energy waste of fixed-arc lighting.

Thus, lighting energy consumption, the largest electrical load segment in commercial and institutional buildings, can be significantly reduced with the employment of this new invention.. The lower cost, energy saving, reduction in environmental pollution goals of the invention, which can be achieved by adopting variable-arc lighting, are accomplished by the unique arrangement of active electronic devices, magnetics, optical signal sensing devices, fiber optics, and suitable light to electrical signal transducers in a manner where a given area's ambient light level is sensed, transduced into an electrical signal. This signal is used to control the frequency of an oscillator which controls alternating on-off periods of electronic switches driving at least one fluorescent GDL and its current limiting ballast element. As the frequency of switching is increased or decreased, the time period for the current allowed to flow in the lamp ballast series combination is controlled, hence the current amplitude can be increased or decreased by the control of the switching frequency. If the switching frequency is increased the time for the current to rise in the series inductor-lamp combination, is likewise shortened hence lower in amplitude with a concomitant lowering of the luminous flux and the electrical energy consumed. The inverse happens when the switching frequency is decreased.

The frequency of operation and the desired wave form of the arc-current drive previously discussed are of fundamental importance in variable-arc operation mode. With an appropriate current drive waveform, approaching an ideal alternating (symmetrical) square wave, the ionization and deionization times and hence energy expended for this function are is minimized. Likewise the circumvention of the greater than 10 volt drop in the Anode fall region of the lamp's arc.which occurs when the arc current drive frequency exceeds the natural oscillation frequency of the plasma arc, suggests an arc operating frequency greater than the natural oscillation frequency to maximize the efficacy of the system.

This system invention is installed when no daylight is present at which time the installer manually adjusts the angular position of a potentiometer shaft, associated with the electronic ballast, to establish the just right level of light, i.e. no overlighting and no underlighting for the particular space's lighting requirement. The installation automatically takes into consideration task background reflectances and the installer adjusts each luminaire's output to a predetermined level that considers the work task and occupant's requirements. Thereafter, if the light level in the installed space changes, due to daylight contributions entering the area, changes in the surround, and/or as a result of the long term luminaire or lamp depreciation, such changes are sensed by the ballast's light level lens assembly, which is mounted on the ceiling, adjacent to the luminaire's light output port.co-located in the space with each luminaire. The changing light level signal is then transferred via a fiber optic bundle to the electronic ballast. Therein the light signal and its variations are transduced into an electrical signal, varying in relationship to any light variations, and that signal is then employed to vary the time-on periods of the alternating arc drive switches in a manner to control the level of arc current flowing through the GDL(s), and hence the luminous flux output from the luminaire, so that the combination of reflectances, any daylight, and the luminaire's light components additive combination is minimally equal to the just right lighting level established initially at the time of installation. When a particular area's lighting requirement changes, a simple readjustment of the electronic ballast's potentiometer shaft, (when no daylight is present) establishes a new "just right" level of luminous flux in that area.

One optional configuration of this invention can utilize the Edison's idea of a central DC power source, and his three wire distribution circuit of the 1880's, consisting of a plus voltage potential conductor, a minus voltage potential conductor, and a return conductor, usually at ground potential, to distribute the DC power source to each luminaire containing an elect-electronic ballast. The second or alternate DC supply source that may be used with the invention utilizes the existing conventional single phase AC power presently delivered to each luminaire and convert the AC into the three wire DC within each electronic ballast in the luminaire. In either case, the DC power is inverted into higher frequency AC power to drive the fluorescent GDLs. In either case, i.e., delivering DC or AC power, as illustrated in block diagram form in FIGS. 8 & 11, to the luminaire, the invention provides novel means to efficiently operate the ballasting elements in a manner that permits variable-arc current control.

One of the important features of this invention is the separation of the cathode heating, power factor, and arc current control power conversion functions in a manner that these functions can be dealt with independently of each other. In this manner the various functions required to properly operate the fluorescent GDL arc over a suitable range only act with each other by design and thus provide the proper timing, protection, and control functions required for variable arc operation. For example, the mandatory pre-requisite of properly heating the cathodes to operate, uses a separate Power Converter from the Power Convertors which supply power fact:or correcting power and arc current power. Thus by circuit design, cathode heating function, critical for long lamp life, can be initiated before control power is applied to the GDLs, hence lamp ignition voltage is reduced and longer lamp life attained. FIGS. 1 & 2 illustrate how three separate Power Converters, AC to DC, Control Power and Cathode Heating, and Arc Current, are employed in the instant invention and their respective relationships to each other required to meet the objectives of this invention. FIGS. 5 & 6 illustrated the arc current switching function and FIGS. 8, 10 & 11 deal the two forms of AC to DC power conversion and their internal and external functional connections FIG. 10 gives further insight to the Power Converter for Control Power and Cathode Heating.

The cathode heating function is properly accomplished by first heating the cathodes by providing the lamp's electrodes with the appropriate external heating voltage, just prior to GDL arc ignition. The cathode heating voltage can then be decreased or eliminated so long as the arc remains at or near its maximum current level. However, if and when the arc current is decreased, the cathode heating voltage must be increased to make up for the loss of arc heating caused by the reduction in arc current. With the separate Power Converter for the Control Power and Cathode Heating Power the external cathode heating voltage can be designed to go to nominally zero after arc ignition takes place and so long as the lamp arc remains high. However, the external heating voltage must be brought back to provide heating of the cathodes when arc current is decreased.

Operation in this manner provides higher efficacy at the expense of a reduction in lamp life to the extent the GDLs are operated as a pre-heat lamp without cathode heating after ignition when operating at its higher arc current levels. Likewise the cathode heating circuit can be designed to go from the pre-arc ignition level down to a minimum 2.5 volts at high arc currents and increase back up to nominally 4.5 volts in the case of using the North American version of a rapid-start operated lamp or an appropriate voltage level when the European bi-pin lamp equivalents to the North American rapid-start lamps are used. Proper cathode heating is a requisite with variable-arc operation to minimally achieve the lamp life objectives claimed by their manufacturers. To do otherwise will cause a building owner or operator to incur increased lamp replacement, and the more important, lighting maintenance labor costs concomitant with the shortened lamp life that occurs with the improper heating of the lamp's cathodes. Control of the external cathode heating voltage is achieved in the instant invention by sensing the varying frequency of the arc current drive, arc current or another arc power related signal and using that signal to increase or decrease the cathode heating voltage.

In final summary, the invention also provides for the proper heating of the cathodes over a wide range of arc current control. Further, inductive ballasting elements are employed that limit the arc current, hence by shortening the time period of the AC arc drive operating cycle (higher frequency), the ballast and arc current rise time is shortened and thus the average current allowed to flow through the GDL is lowered. This is how this invention achieves variable-arc operation. Still further, the half bridge switch timing is arranged so that between the turn off of one of the electronic arc current control switches and the turn on of the alternate switch, a suitable time period in which both switches are off during which time period resonant transfer occurs between the inductively stored energy and the stray and intrinsic capacitor stored energy is usefully utilized by the GDLs. Without this switching delay for the resonant transfer of the stored energy to take place, the stored circuit energy would, inefficiently and possibly damagingly, be dissipated in the junction of the electronic switch being closed. Furthermore, the essential resonant transfer can only take place in a closed circuit and provision must be made for the case where lamps may wear out or maintenance personnel may remove the lamps in early re-lamping programs with the luminaire electrically energized, in which case, and lacking a closed load circuit, the two arc drive electronic switches would have to dissipate the circuit stored energy. Thus, this invention makes provision for a continuing closed circuit by providing a protect inductor in shunt with the series GDL and current limiting inductors to provide a closed circuit path when for any reason the lamp(s) are effectively out of the circuit.

The cathode heating function is properly accomplished by first heating the cathodes with the appropriate external heating voltage just prior to GDL arc ignition. The cathode heating voltage can then be decreased so long as the arc remains at or near its maximum current level. However, if and when the arc current is decreased and the cathode heating voltage is has been decreased, the cathode heating voltage must be increased to make up for the loss of arc heating caused by the reduction in arc current. With the separate Power Converter for the Control Power and Cathode Heating Power the external cathode heating voltage can be designed to go to zero after arc ignition takes place and so long as the lamp arc remains high, but then it must be, increased as the arc current is decreased.

Operation in this manner provides higher efficacy at the expense of a reduction in lamp life to the extent the GDLs are operated as a pre-heat lamp without cathode heating after ignition. Likewise the cathode heating circuit can be designed to go from the pre-arc ignition level down to a minimum 2.5 volts at high arc currents and increase back up to 4 volts in the case of using the North American version of a rapid-start operated lamp or an appropriate voltage level where the European bi-pin lamp equivalents are used. Proper cathode heating is an essential part of variable-arc operation in order to minimally achieve the lamp life objectives claimed by lamp manufacturers. To do otherwise will cause a building owner or operator to incur in increased lamp replacement and the more important lighting maintenance costs concomitant with the shortened lamp life of improper heating of the lamp's cathodes. Control of the external cathode heating voltage is achieved in the instant invention by sensing the varying frequency of the arc current drive, arc current or power.

DETAILED DESCRIPTION OF THE DRAWINGS

Figure 1:
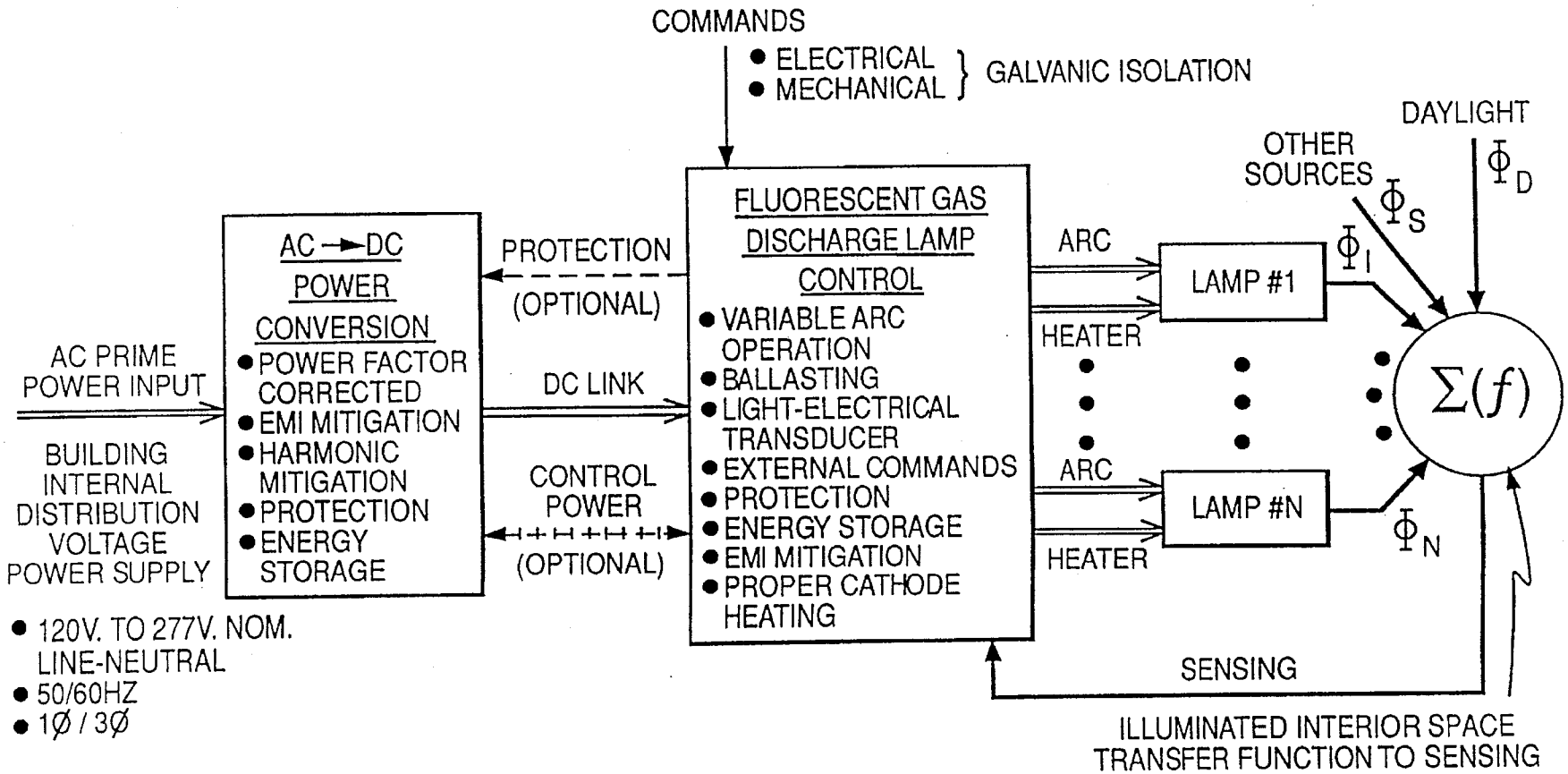

FIG. 1 illustrates the top level functional block diagram titled, Variable-Arc Fluorescent Gas Discharge Lamp Operation System. It is a top level functional block diagram which shows the power flows, links, and lists the various functions that must be accomplished by each identified block. The AC to DC power conversion block provides DC power to the Fluorescent Gas Discharge Lamp Control block which supplies the proper amount of cathode heating current and arc current power to the GDL(s). The GDL blocks provides light output to the area being lit and a light sensing function which senses the aggregate surface illuminance selected for the interior space being illuminated by a combination of free natural (daylight) and costly GDL (artificial) light sources. This sensed light signal is transduced to an electrical feedback signal to the Fluorescent GDL Control, where in conjunction with command signals leads to the control of the amplitude of the arc current permitted to flow through the GDL(s).

Figure 2:
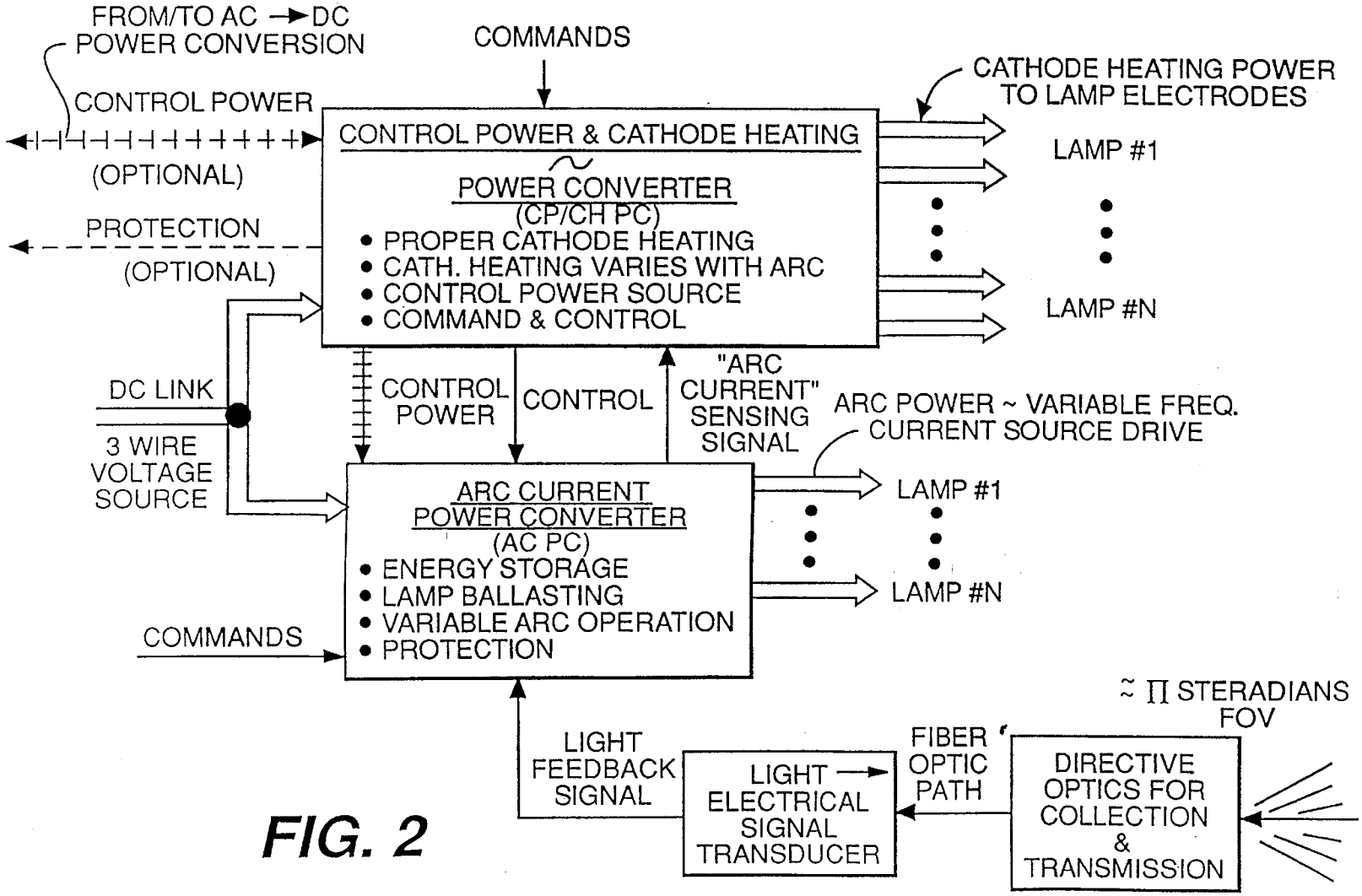

FIG. 2 illustrates the division of functions of the Fluorescent Gas Discharge Lamp Control. The DC link (three wire voltage source) provides power to the Arc Current Power Convertor (AC PC), which supplies the current controlled arc power to the fluorescent GDL(s). The Control Power and Cathode Heating Power Converter (CP/CH PC), supplies appropriate cathode heating power to the electrodes, and is also powered by the DC link voltage. Further shown by FIG. 2 is the directive optics for the collection and transmission of a measure of the sensed light of the interior space to an optical to electric transducer establishing a light feedback signal to the Arc Current Power Converter.

With respect to meeting the cathode heating requirements for wide range variable-arc current lamp operation, neither instant-start, pre-heat, nor fixed electrode voltage rapid-start methodologies are suitable. The Instant-start and preheat methodologies are ruled out because they are totally dependent on the lamp's arc current to keep the cathode at an adequate electron emitting temperature. Hence, a lowering of the arc current with its concomitant reduction in the cathode temperature, would significantly reduce lamp life, making instant-start and/or pre-heat variable-arc current lamp operation unacceptable.

The use of the traditional fixed electrode voltage rapid-start lamp arc ignition and sustaining methodology could be marginally acceptable with limited variable arc current operation before lamp life begins to decline due to improper cathode heating. However, if wide range arc current variation is required, and rated lamp life is to be maintained, the traditional fixed electrode voltage rapid-start methodology can not be employed. As previously described, as the arc current is reduced, the cathode heating contribution of the lamp's arc is established at a level that will maintain the cathode at a suitable electron emitting temperature, diminishing to the point of inadequacy. The instant invention prevents the latter from happening by providing unique means to compensate for the reduced arc current. This is accomplished by increasing the externally applied electrode voltage to the cathodes, thus providing a first order compensation for the loss of heating due to the arc current reduction.

The cathode heating compensation is made possible by the separation of the cathode heating power function from the arc current power drive function by employing separate DC to AC power converters for the cathode heating and the arc drive. In addition to this functional separation, a signal, roughly proportional to the amplitude of the arc current needs to be derived from the Arc Current Power Converter and used by the Control Power/Cathode Heating Power Converter to increase the cathode heating voltage inversely to the arc current, i.e., as the arc current decreases, resulting in a corresponding decrease in the arc's cathode heating contribution, the cathode heating voltage needs to be increased as the means to make up the lost arc heating contribution from the declining arc.

Figure 3:
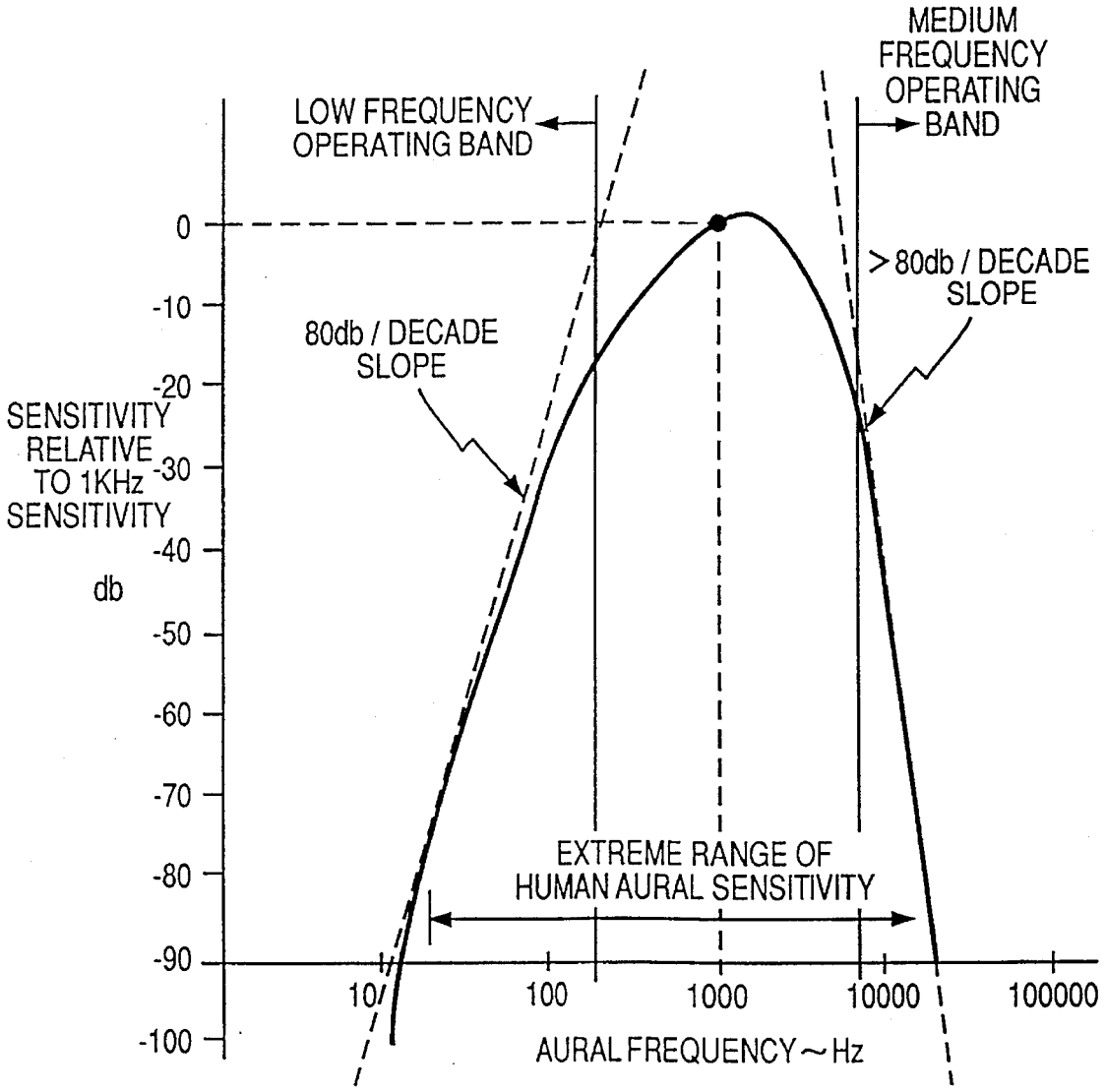

FIG. 3, which illustrates the relative sensitivity of the human aural system to frequency is nominally limited to the 20 to 20,000 Hertz band. However, as FIG. 3 clearly shows those limits represent sensitivities 80 db down from the 1 kHz mid frequency region. Further observation shows the slopes are +80 db/decade on the low frequency and greater than −80 db/decade on the high frequency side. These characteristics define two potential operating bands where acoustic interference would be minimized to an acceptable level. These two bands can be determined by taking the −20 db sensitivity level, which is a power level, 1/100th of the mid-range of that associated with hearing, shows that 200 Hertz downward and 8,000 Hertz upward GDL operation would be acceptable from the human aural standpoint. Further, if the GDL arc is to operate at 8 kHz or above it is well above the telephony 300–3,000 kHz voice band as well as the 2 to 3 kHz natural relaxation frequency of the plasma and therefore these two restraints can be eliminated with respect to the arc frequency selection. Avoiding harmonic current generation and EMI interference problems as relating to the selected frequency is a matter of printed wiring board design, component selection, filtering and capacitive decoupling where necessary. FIG. 3 also illustrates that operating at frequencies less than 200 Hertz per second (low frequency band) will avoid the telephone and acoustic noise interference problems.

Figure 4A:
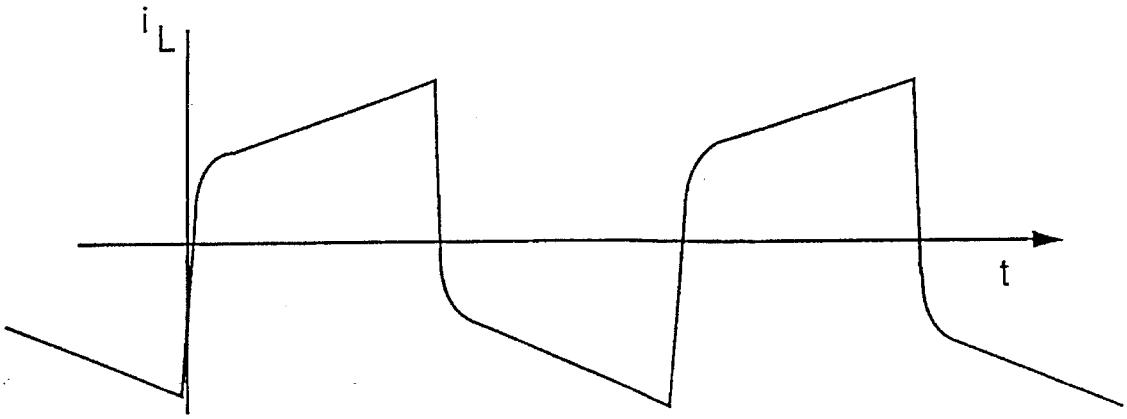
Figure 4B:
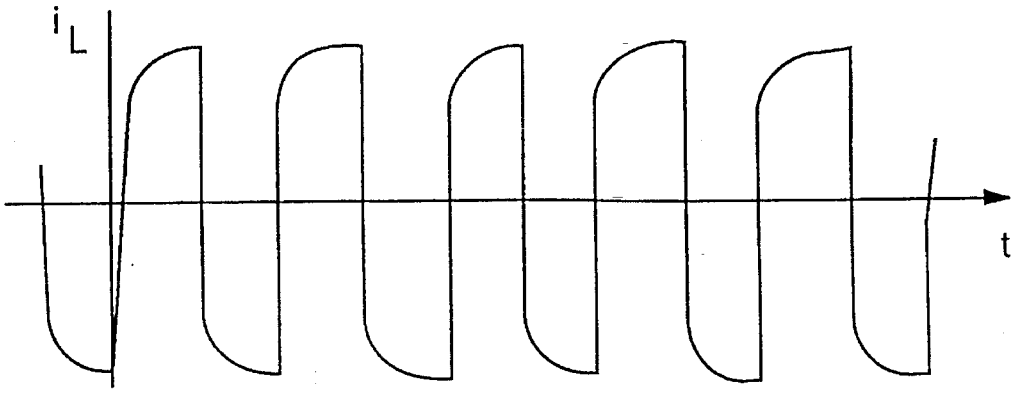

FIG. 4 illustrates variable arc operation GDL current wave form output, in generic form, of an Arc Current Power Converter (AC PC) in the low frequency (less than 200 Hertz per second) operating band and in the medium frequency (above 8,000 Hertz per cycle operating band).

Figure 5:
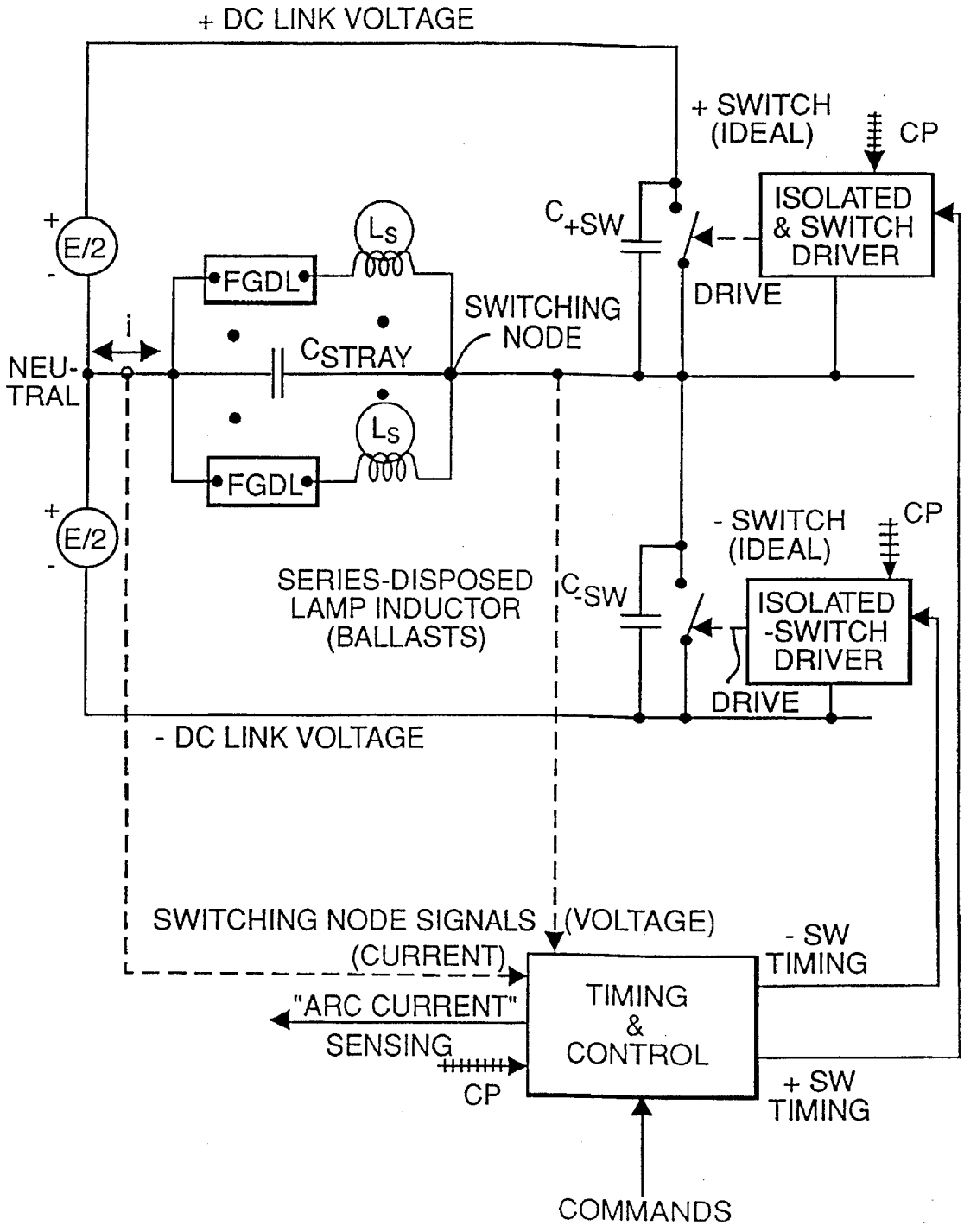

FIG. 5 is a functional circuit schematic of a Generic Half-Bridge Switching Inverter alternately closing the plus switch to alternately drive inductor (L) ballasted fluorescent GDLs (FGDL) from the most plus and the most minus voltage source(s) at the Arc Current Power Converter's switching frequency. Of key importance to the operation of the Half Switch Switching Inverter is the capacitance $C_{stray}$ shown in shunt with the FGDLs, and the $C_{+SW}$ and the $C_{-SW}$ capacitance adjacent to the plus and minus switches (ideal). These capacitances respectively represent the stray circuit capacitance and the intrinsic switch capacitance(s) and must be considered to the extent they represent stored energy, i.e., $W=\frac{1}{2} CV^2$, and significant amounts of stored energy might have to be dissipated in the switching elements if not properly timed. For example, at the instantaneous time that the plus switch is turned off the instantaneous voltage across that switch will greatly increase. Because the switch has an intrinsic capacitance value and the voltage across it could be several hundred volts, it stores energy in accord with the formula $W=\frac{1}{2} CV^2$. If the alternate switch were then turned on while that energy was still stored in the switch or circuit, most of it would have to be dissipated in the switch's junction.

At low frequency the dissipation would be trivial and would be ignored but at higher frequencies, say 30 to 40 kHz per second a significant amount of energy to be dissipated would lead to a life shortening temperature rise. Hence, enough time must pass between turn-off of the first switch and the turn-on of the alternate switch for the stored energy, due to the intrinsic capacity in the switches and the stray circuit capacitance, to be usefully discharged through the fluorescent GDL(s) via resonant transfer between the inductances and the capacitances associated with the switching node. This is accomplished by selecting a frequency dependent time delay between the turn-off of one switch and the turn-on of the alternate switch during which time period the resonant transfer action takes place and the majority of the circuit stored energy is usefully converted into light. Note that when control power (CP) is applied to the timing and control block of FIG. 5 the signal information, i.e., the arc current sensing combined with the switching node and command signals illustrated with arrows in FIG. 5 combine to determine the frequency of operation of the Conductively Isolated Switch Drive.

Figure 6:
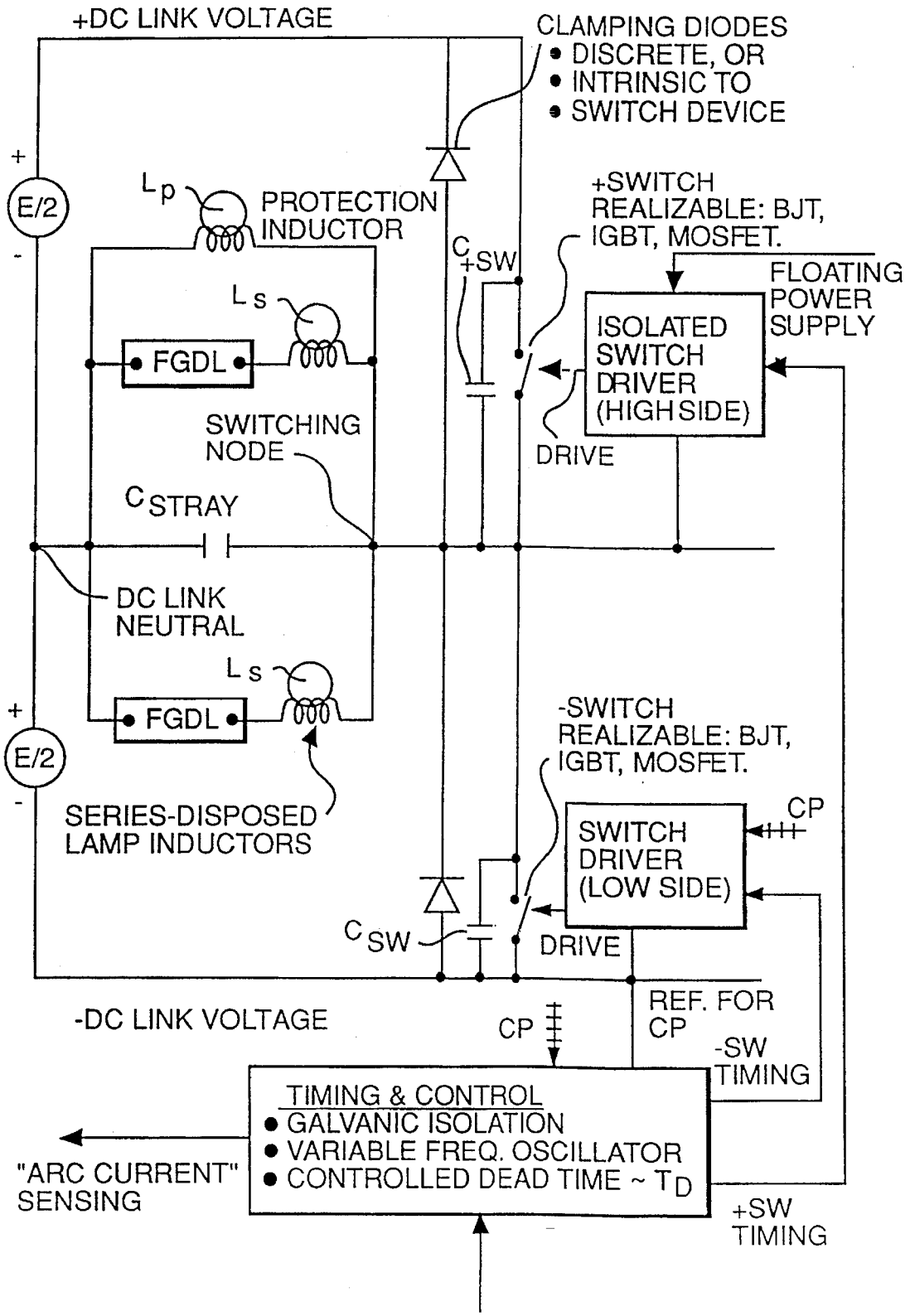

FIG. 6 illustrates a functional circuit schematic of the invention's Half-Bridge Switching Inverter showing how the clamping diode is intrinsic to typical devices, which may be discrete components, to protect, for example, a bipolar transistor with insufficient reverse voltage withstand or how it would be intrinsic to the switching device if today's N channel enhancement FETs were used as the switching devices. The $L_p$, Protection Inductor in shunt with the fluorescent GDL(s) and $L_s$ (s) serves the purpose of providing an inductive energy storage to effect resonant transfer and prevent $\frac{1}{2} CV^2$ dissipation in the event all of the lamps have failed or are removed for replacement purposes and the maintenance personnel fail to de-energize the luminaires. The operation of the ballast without lamp arc current or a Protection Inductor would effectively remove the resonant transfer of the stray and intrinsic capacitance to the Series Disposed Lamp Inductors that occurs during the short time interval between the turn-off of one switch and the turn on of the alternate switch. With the Protection Inductor, a minimum current, i.e., that flowing through the Protection Inductor is present. To do otherwise the Half Bridge Switching Devices would have to dissipate any $\frac{1}{2} CV^2$ stored energy with the chance of adverse thermal consequences to the switching devices. Obviously, other current conducting elements could be employed to keep a small closed current flowing when there is no lamp arc current flow, however an inductor, with its reactive power flow characteristic and hence no first order power dissipation, would be desirable over a resistor with its active power dissipating characteristic.

Figure 7A:
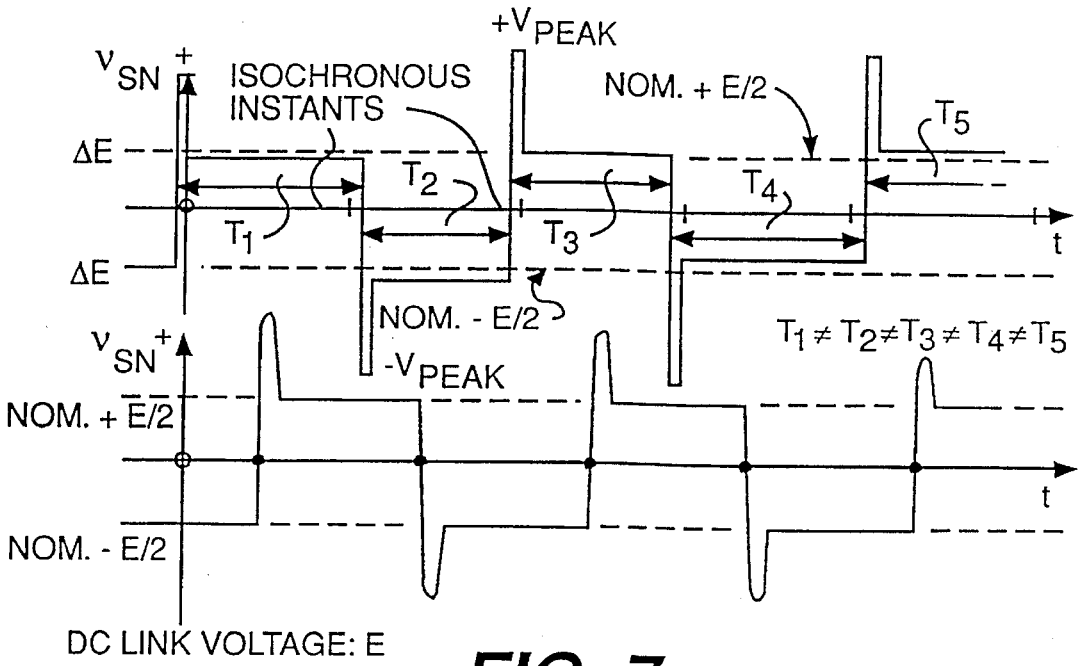
Figure 7B:
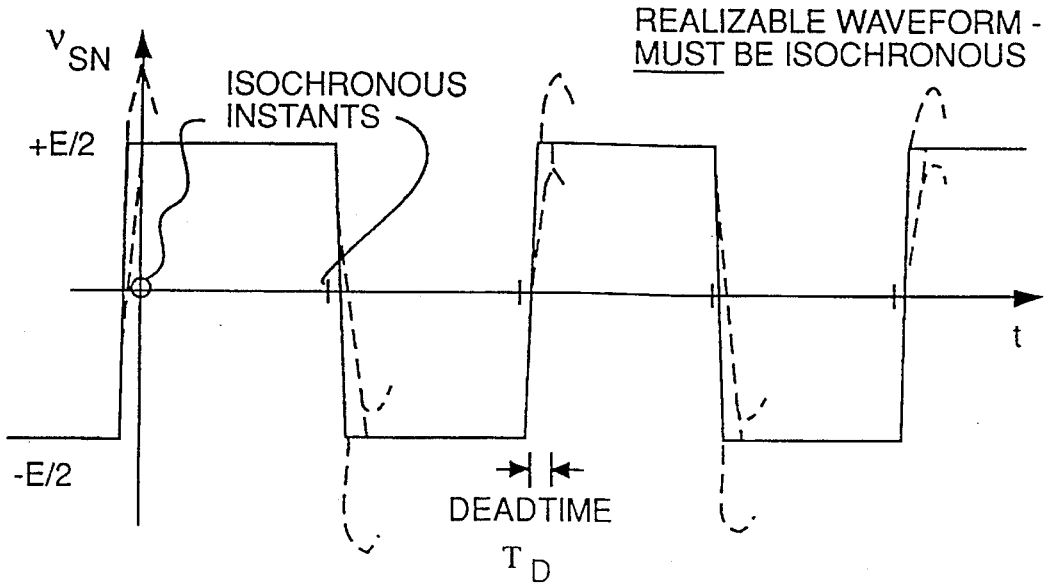

FIG. 7 illustrates three Switching Node Voltage Waveforms. The first waveform, (a)l, is a generic form Ideal waveform of non isochronous operation wherein the time interval of each plus and minus wave can vary in a manner that equal volt seconds are applied to the fluorescent GDL ballasting elements despite variations in the applied DC voltage. Further the relatively high leading edge voltage serves the useful purpose of causing rapid current reversal. The second wave form, (a)2, departs from the ideal waveform and illustrates a realizable waveform with isochronous operation which could however be operated in a non isochronous fashion as shown in the first waveform. It also utilizes the high leading edge voltage to accomplish rapid current reversal. The third waveform, (a)3, shows that the high voltage leading edge voltage, which is desirable for rapid current reversal, is clipped as a result of using an N channel field effect transistor (FET), because such FETs intrinsically have a parasitic bipolar npn transistor across its drain-source terminals, that acts as a clamping diode to prevent reverse voltage across the drain-souce. During the period of time when neither of the Half Bridge switches are conducting, resonant transfer action occurs between the inductances and the stray and intrinsic capacitances; thus the circuit stored energy is effectively utilized in lieu of being dissipated in the switching elements.

Figure 8:
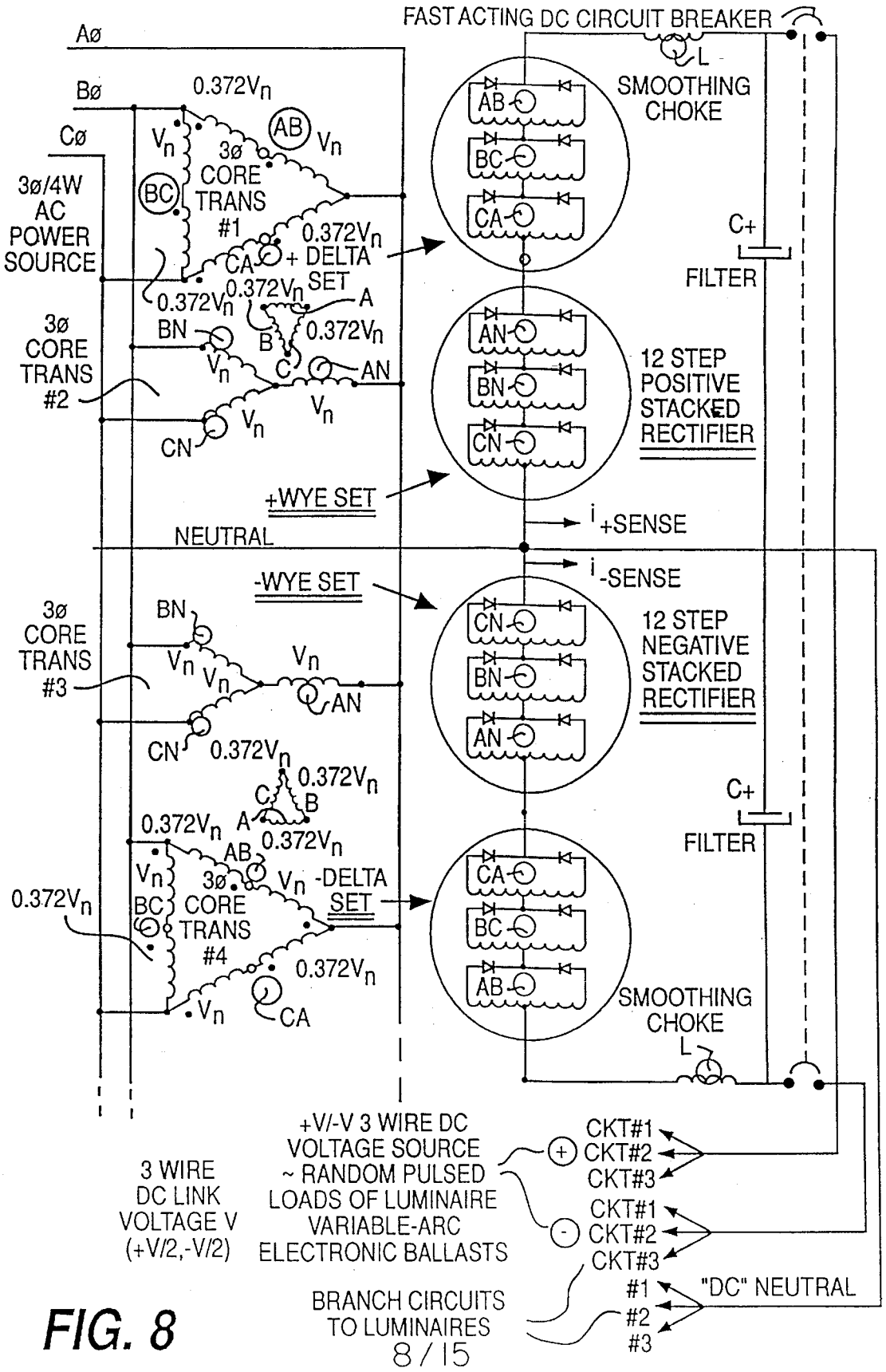

FIG. 8 illustrates the Central Power Converter approach to the AC to DC Power Conversion polyphase prime power supply in circuit schematic form for a 3 wire DC Link. The positive voltage is obtained by stacking, i.e., series connecting the full wave rectified transformer secondary voltage of each phase of the delta connected primary set and the wye connected primary set. The rectified voltage of each of the six secondary windings of the two transformer sets (either a 3 phase core type transformer or a set of three single phase transformer or other) a smoothing choke are connected in series and shunted with filter capacitor (C) to form the positive voltage half of the 3 wire DC Link. The transformers are designed so that the output voltages, of both the secondaries of both the delta and wye set, are equal to minimize the DC harmonics.

The negative voltage is likewise similarly obtained from the DC neutral which is shown as an extension of the AC side neutral, but may indeed be separated and isolated. The circuit breaker protected positive and negative terminals of the Central Power Converter form the 3 wire DC Link Voltage. V for distribution via either the existing three wire (load, neutral, and ground) AC distribution branch, or, alternatively new circuits, to feed the luminaires containing the deployed variable-arc electronic ballasts now simplified to only the Fluorescent Lamp Control fraction.

Several benefits arise from this voltage stacking methodology over conventional three phase rectification, i.e., the diodes commutate at the zero voltage crossover of the AC line voltage instead of at the 60 and 120 degree points of the two switching phases, hence the diode "short circuit" commutating problem with its concomitant current distortion of conventional three phase rectification is eliminated. Further it inherently provides high power factor, minimal current distortion, and inherently balances the building of buildings' lighting load thus eliminating lighting load balancing problems that single phase lighting distribution has to deal with. It also provides a convenient 3 wire DC link.

Figure 9:
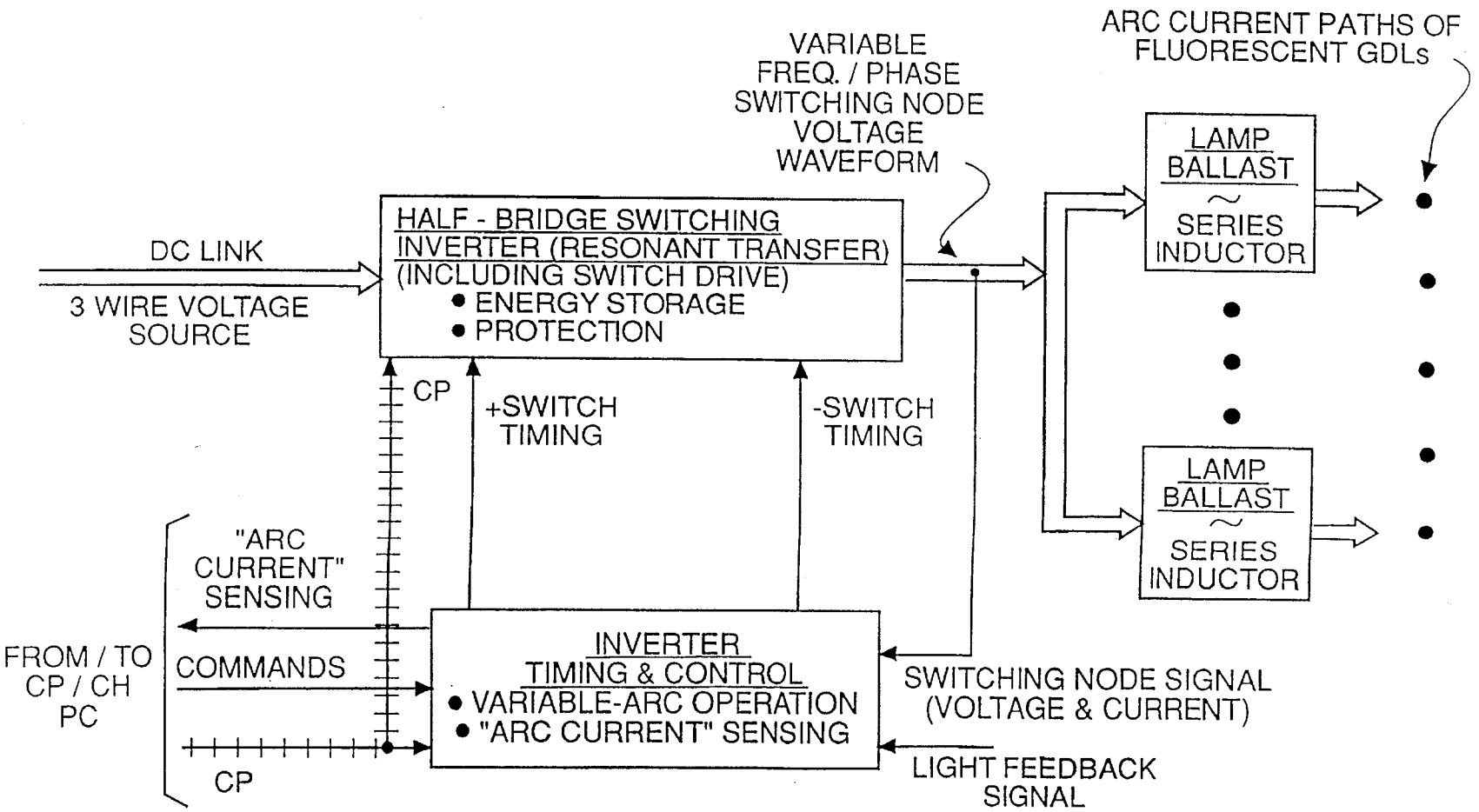

FIG. 9 is a generic functional block diagram of the Power Converter for Arc Current Drive. It consists of a Half-Bridge Switching Inverter (HBSI) circuit which includes switch drive and resonant transfer functions and an Inverter Timing & Control function plus N number of lamp ballast elements, i.e., series connected inductors. Electric power, control power and control signal information, both into and between the diagram's blocks, are illustrated. After the finite cathode heating delay period, the HBSI begins to operate as intended; it inverts the DC Link voltage source into variable. frequency AC with a specified voltage at the switching node. This functionality is achieved by being able to alternate the power flow from the positive side of the three wire DC source voltage to the negative in a time varying fashion. The power flow timing is controlled by the Inverter Timing and Control which generates timing to the switch drive function. The Timing and Control signals are generated in relationship to the command and the light and/or current feedback signal information received by the Inverter Timing and Control function. The variable frequency switching node voltage output of the HBSI drives the paralleled series inductances ballasted fluorescent lamps The current limiting function for the fluorescent GDL is identified in FIG. 9 as the Lamp Ballast. The ballasting elements must be selected or designed to limit the AC current flow through the GDL to some maximum level which should not exceed the maximum arc current rating of the fluorescent GDL's, when the HBSI is operating at its lowest (low-limit) frequency. Hence, whenever the electronic ballast's arc drive operating frequency is increased above its "low limit" frequency, the current flow in the lamp and lamp ballast will reduce. This arc current reduction, which occurs at any frequency greater than the low-limit frequency, occurs because the cycle to cycle time of the higher frequency is shorter than that of the "low limit" frequency, hence the current flowing in the ballasting element has less time to rise before the next switching alternation cycle (less time for the current limiting inductor's magnetic energy storage, or the capacitor's energy storage, function to take place; therefore the average or rms arc current is lower.

A switching node voltage and current signal from the power flow output of the Half-Bridge Switching Inverter to the Inverter Timing & Control block is contained in FIG. 9. Further to the previous discussion on selecting the frequency of the GDL(s) arc operation, several factors weigh in its selection; the first consideration is relatively important and that in order to maximize the efficacy the GDLs is to operate the arc at a frequency greater than the natural oscillation frequency of the arc plasma to avoid the lower operating frequency penalty of a the nominal 15 volt non-light producing voltage drop called the anode fall voltage; another consideration is to avoid the possibility of causing telephone interference by not operating in the telephone band frequencies (300 to 3,000 Hertz); a further consideration is to avoid the human aural sensitivity band to minimize the possibility of generating noticeable acoustic noise within the ballast, still another consideration is to avoid operating at frequencies whose base band or unfiltered harmonics might fall within any of the broadcast radio bands and create unallowed radio frequency interference. It is also well known that, as the frequency of electronic ballast operation increases, so do switching losses because, in general, there is a fixed loss incurred during each switching cycle. However, and as a possible offset to the switching losses, with higher frequency operation smaller ballasting elements can be used, with less ballasting losses.

These factors, among other, influence the arc operating frequency of choice for electronic ballasts. Most of today's fixed-arc electronic ballasts operate between 30,000 and 40,000 Hertz per second. This means that if a circuit with even a trivial amount of stray capacitance is switched on when the voltage across the circuit is high, the switching losses in terms of watt seconds can become substantial and the vast majority of the switching losses must be dissipated in the switch when a switch each time that switch is turned on. For example, the watt seconds resulting from the stray circuit capacitance is equal to $\frac{1}{2}$ C $V^2$ and in a typical electronic ballast operating at low frequency, e.g., 60 Hz per second, would be trivial but operating at 40,000 Hertz per second care must be taken to insure that switch closure only takes place when the voltage is approaching zero. Hence any $CV^2$ at turn-on of the next switch will be minimal. Thus, at the time one switch is turned off means must be provided to insure that the current must continue to flow in the load circuit until the cycle voltage is approaching zero before the other or alternate switch is closed. To do otherwise all of the stray capacitive stored energy of the circuit elements will be dissipated in the switch being closed leading to the dissipation of electrical energy in a non useful way with an unnecessary life shortening, dissipative heat rise in the switching elements.

Figure 10:
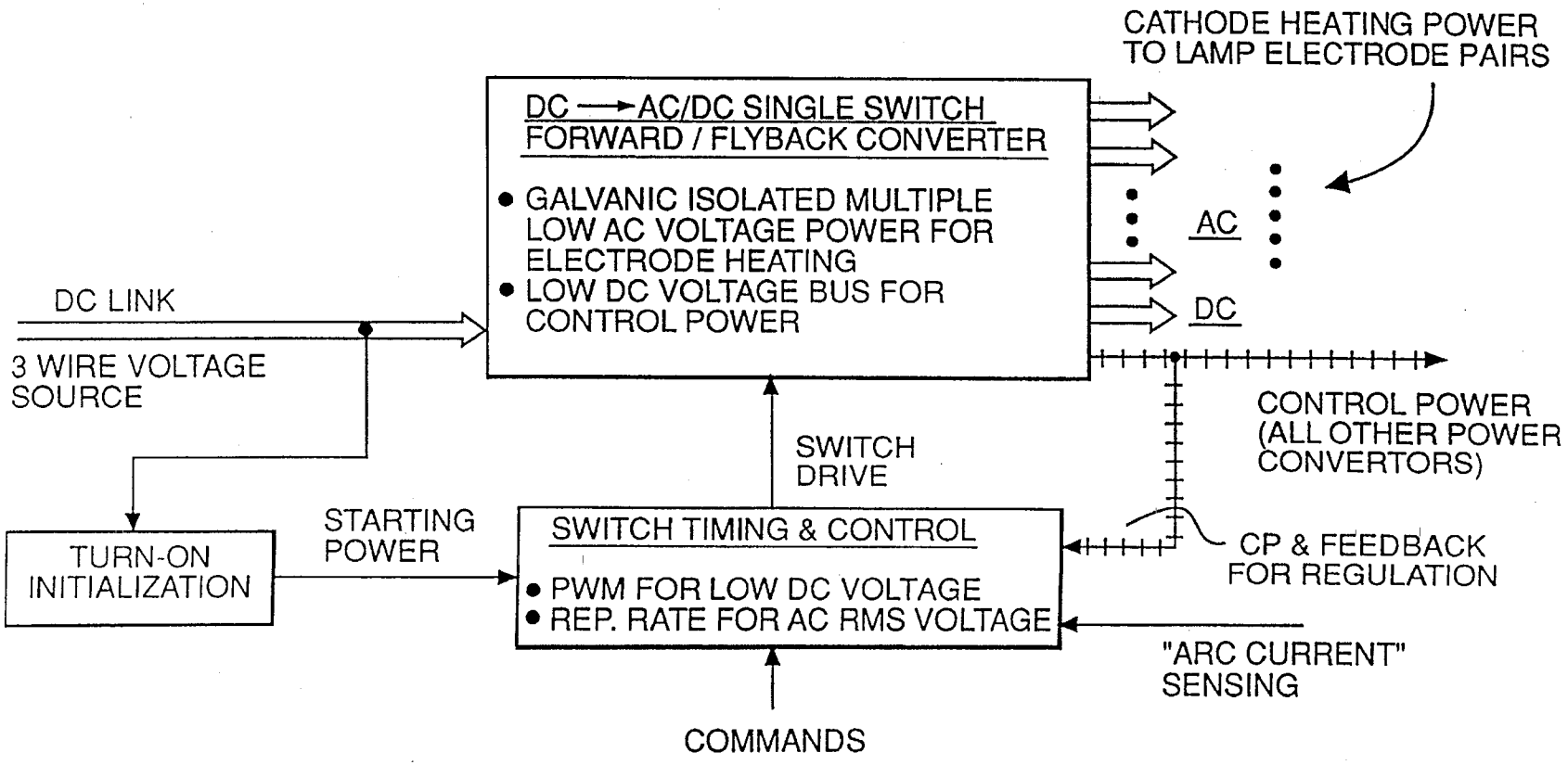

FIG. 10 expands upon the Control Power & Cathode Heating Power Converter (CP & CH PC) block, shown in FIG. 2, by breaking it into three blocks The first is the DC-AC/DC Single Switch Forward/Flyback Converter block. The second shows a Switch Timing and Control block and the third illustrates a Turn-on Initialization block along with signal and power flow information. Overall the three blocks form a functional block diagram of the Power Converter for Cathode Heating & Control Power which operates as follows. The availability of the DC link voltage causes a turn-on initialization function providing starting power to the Switch Timing and Control (ST&C) block. In turn, switch drive is provided to the DC-AC/DC Single Switch Forward/Flyback Converter which supplies the cathode heating power to the lamp electrodes, i.e., nominally 4 volts to each lamp electrode for cathode heating purposes and DC control power for all other converters including the Arc Current Power Convertor (AC PC) shown in functional block diagram in FIG. 9. After an appropriate time constant delay of milliseconds in the AC PC, to allow the lamp's cathodes to come up to their electron emitting temperature, the CP/CH PC provided DC control power to the AP PC provides power to the heated cathode lamps and the GDL lamp arc ignition occurs. After lamp arc ignition occurs the AP PC provides an electrical signal, proportional to the lamp's arc current density or power, back to the CP/CH PC's Switch Timing & Control block. This "Arc Current Sensing" signal is utilized to cause an adjustment of the initial applied 4 volts applied to the lamp's electrodes for cathode heating purposes. The initial 4 volts pre-ignition voltage is reduced to 2.6 volts so long as the lamp is operating at its maximum rated arc current, hence when it makes its maximum cathode/anode heating contribution. Further, when, for control purposes, the arc current density is reduced, the cathode heating voltage applied to the lamp's electrodes, is proportionally increased so as to nominally approach the pre-ignition cathode heating voltage when the fluorescent GDL arc current is controlled down to the systems minimum level. Thus the proper cathode emitting temperature is maintained over a wide range of variable-arc current operation by the separation of the arc power from the cathode heating power and then allowing the cathode heating power to increase its heating contribution to the cathode as the heating contribution of the arc diminishes with a downward adjustment of the lamp's arc current. FIG. 2 illustrates the arc current related signal as the "arc current sensing" signal flowing from the AC CP block to the CH/CP PC block as well as other signal and power flow information. The voltage values cited above as being supplied to the lamp's electrodes, for cathode heating purposes, are for the 30 to 40 watt rapid start (bipin) fluorescent lamps commonly utilized in North and South America. Similar cathode heating function technology can be utilized with counterpart fluorescent lamps used in Europe and other countries which have higher cathode heater resistances with suitable adjustment being made in the value of the externally applied electrode voltage for cathode heating purposes.

Figure 11:
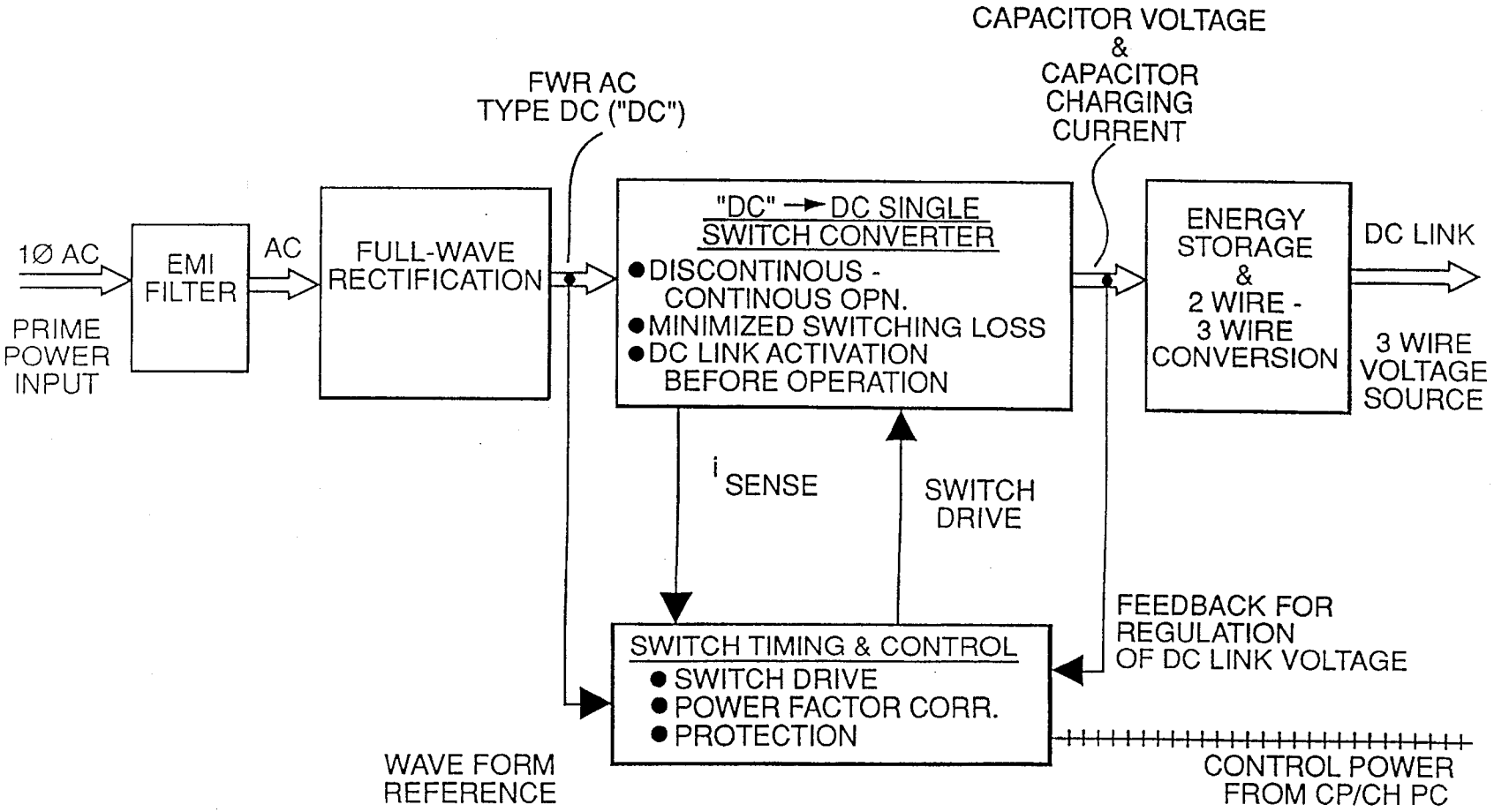

FIG. 11 illustrates a functional block diagram of Single phase AC to DC Power Conversion required to provide an electronic ballast the DC link voltage of reasonable quality, virtually unity power factor, and a total harmonic distortion of nominally 10%. The block diagram illustrates an EMI filter block in diagrammatic relationship with the single phase prime power input. This filter minimizes the opportunity of any ballast generated EMI being conductively coupled back into the AC voltage source. From the Filter block the AC prime power flows to the full-wave rectification block where the AC is converted into pulsating DC. The next functional block is the DC to DC Single Switch Converter working in concert with the Switch Timing and Control block. The latter control block receives its control power from the Cathode Heating/control power converter, FIG. 3, which provides the switch drive to the DC to DC Single Switch Converter and power factor correction and protection functions. The DC to DC converter provides a current sensing signal to the Switch Timing and Timing Control block, a feedback signal for regulating the DC Link voltage and power flow to an energy storage block which provides a three wire voltage source as the DC Link voltage.

Figure 12:
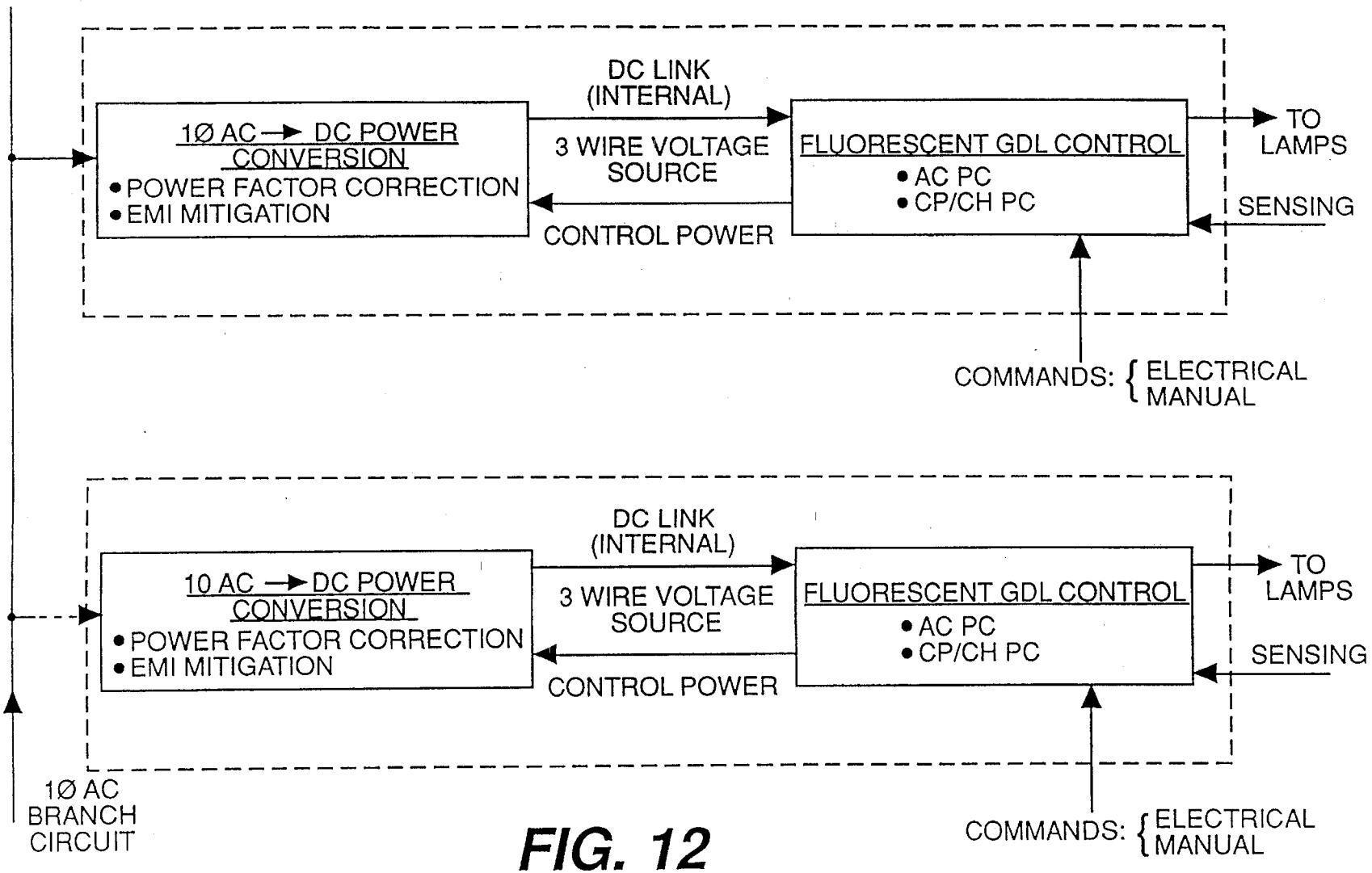

FIG. 12 illustrates a functional block diagram of a Single Phase AC Variable Arc Electronic Ballast showing a single phase AC-DC Power Conversion block providing a three wire DC voltage source to a Fluorescent GDL Control section consisting of the Arc Control Power Converter and the Cathode Heating/Control Power Converter. An examination of FIG. 12 demonstrates that each Variable-Arc Electronic Ballast converts the single phase AC prime power into DC, and in a commercial building a plurality of such ballasts are generally connected to the single phase breaker circuits in the electrical distribution lighting panels within a building. Care must be taken to have nominally equal numbers of electronic ballasts connected to each phase of the polyphase power which is run to each distribution panel.

The conversion of polyphase AC to DC is simpler since in general only involves the rectification step and if any energy storage is necessary, it is minimal. The AC to DC conversion losses are generally less, although in a conventional 3 phase, 6 diode rectifying bridge AC to DC there are diode commutating loses, i.e., there is a finite time, during the diode switching period, when a short circuit current is present and the voltage is relatively high. These finite time commutating losses which also generate harmonic currents, occur when one diode, rectifying one phase, is turning off but is still conducting and when a second diode is turning on to begin conduction of the next phase. While the diode switching action of a 6 diode bridge occurs at a point in time when the voltage is relatively high whereas when rectifying single phase AC power the diodes switch in pairs around zero volts; hence the switching losses are trivial. The instant invention includes means to avoid the diode switching or commutating losses normally associated with three phase power rectification by first transformer isolating the three phases before rectification, then rectifying the secondary voltage of each transformer and then connecting the rectified pulsating DC from each secondary in series with each other to form continuous DC power. By grounding a center tap on the secondary voltage winding of the isolating transformer, the three wire, center ground, DC Link voltage source can be fed to the luminaires over the same three wires which previously provided the AC and ground wire to the luminaires.

Figure 13:
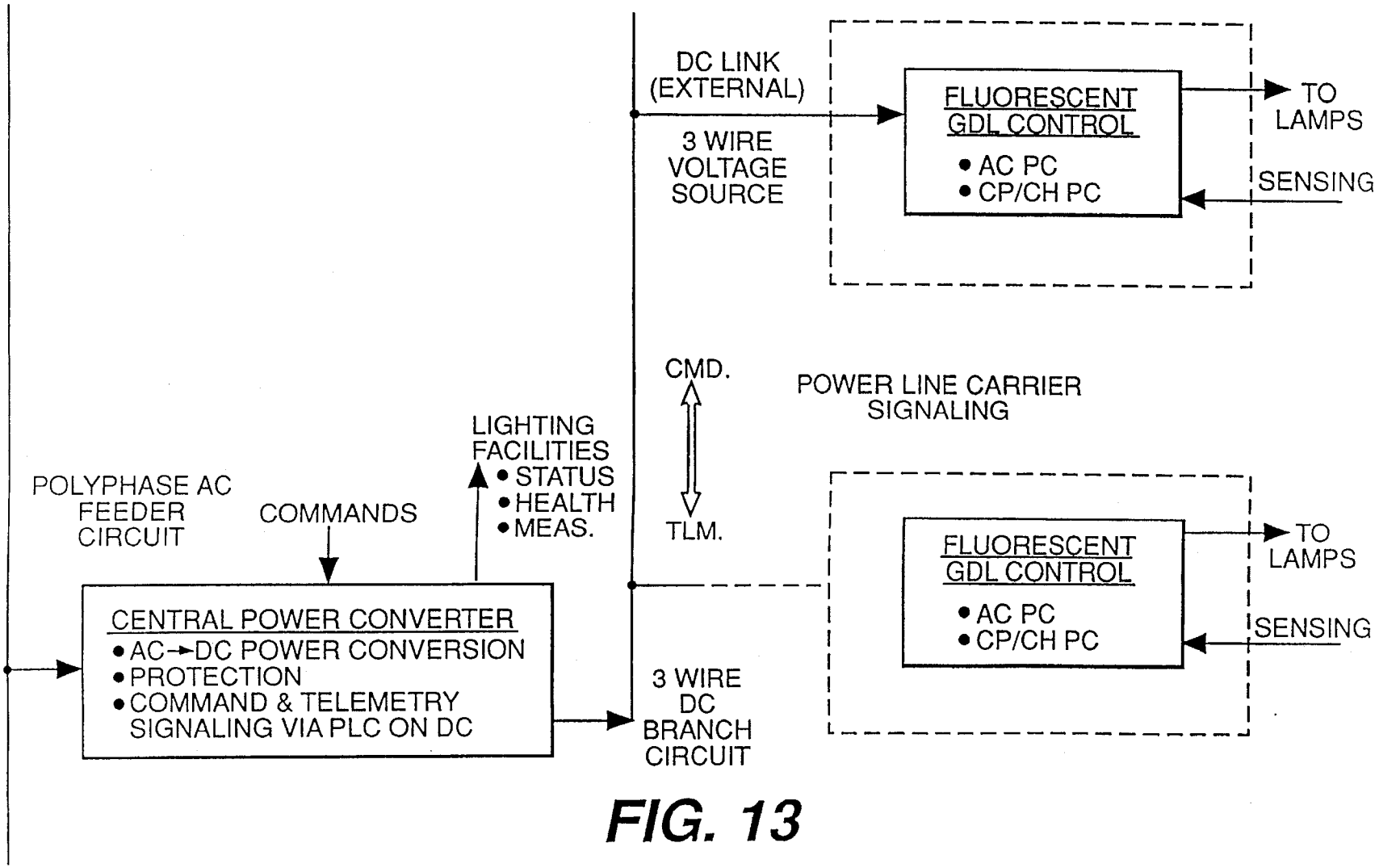

FIG. 13 illustrates a functional block diagram showing a Central Power Converter block delivering 3 wire DC power to one or more Fluorescent GDL Control(s) each of which is located in a fluorescent lamp luminaire. The Fluorescent GDL contains the Arc Power Converter (FIG. 9) and the Control Power/Cathode Heating Power Converter (FIG. 10) whose output power drives the fluorescent GDLs in its associated luminaire.

Figure 14:
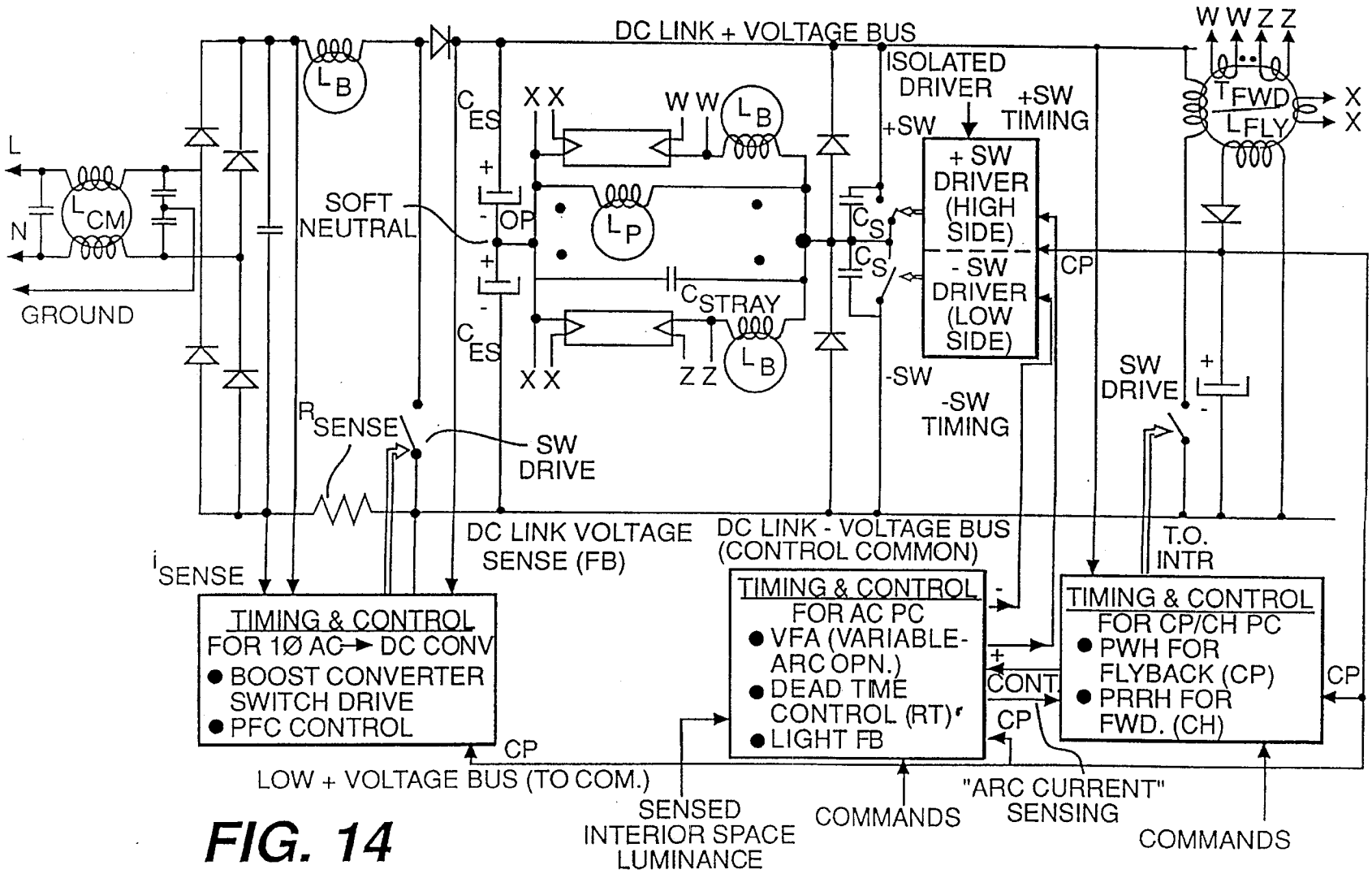

FIG. 14 illustrates a Simplified Circuit Schematic of an Electronic Ballast which includes a single phase AC to DC Power Converter (FIG. 11) coupled to an Arc Current Power Converter (FIG. 9) and the Control Power/Cathode Heating converter (FIG. 10). The Simplified Circuit Schematic shows that the timing and control power for the DC to DC Single Switch Converter of (FIG. 1) as well as the Timing and Control for the Half Bridge Switching Converter (FIG. 9) both derived from the flyback transformer in the Control Power/Cathode Heater Power Converter which is separated from the Arc Current Power Converter. Thus, a simple RC circuit can provide a delay until the GDLs cathodes are properly heated before arc ignition is allowed and hence give longer lamp life with the attendant advantage of lowering the GDLs starting voltage as compared to the voltage required to cause GDL ignition with the instant start technology previously described.

VI DESCRIPTION OF THE PREFERRED EMBODIMENT

Figure 15:
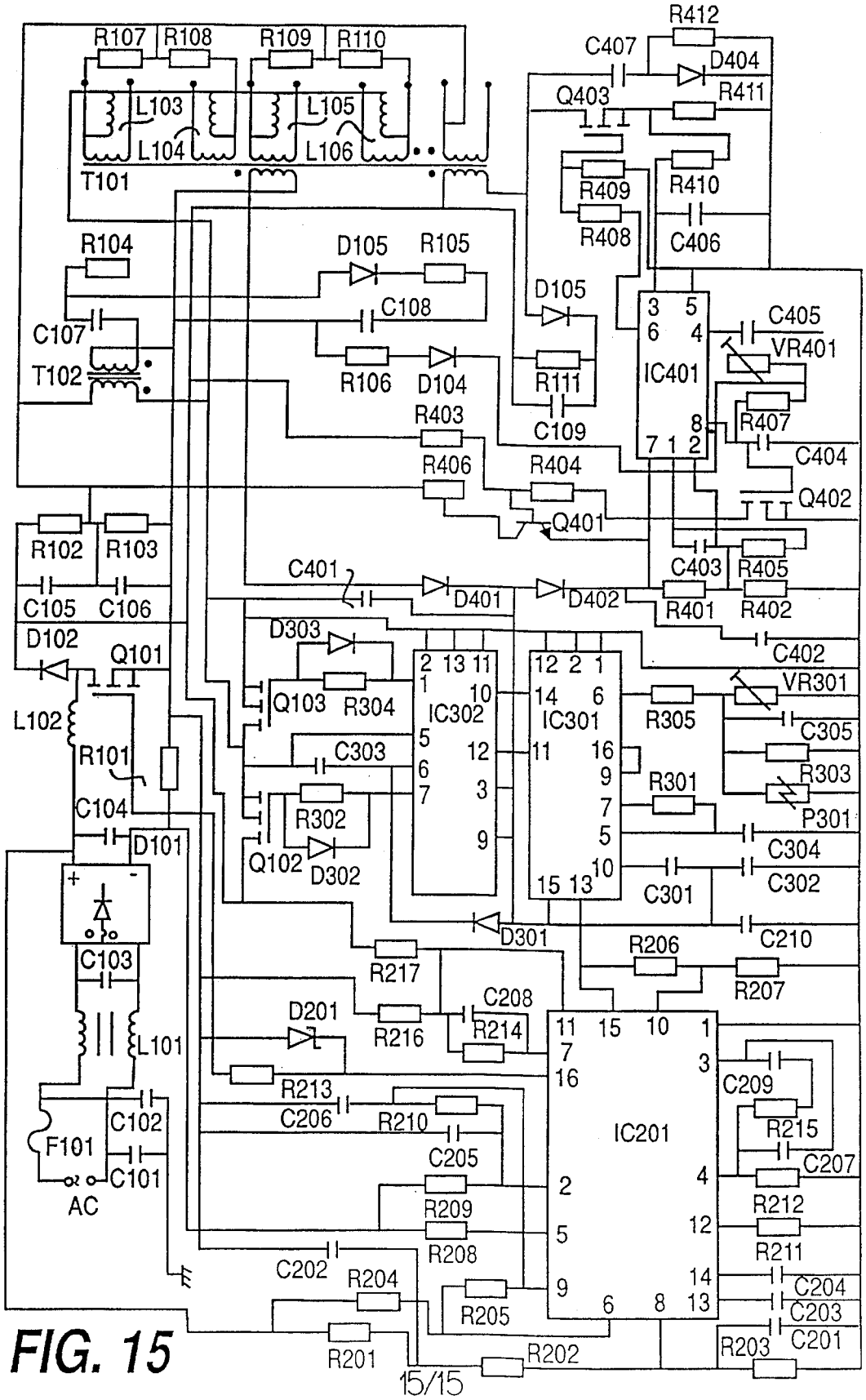

FIG. 15 is a detail schematic of the Electronic Ballast illustrated in block diagram previously identified as FIG. 12. All of the components identified in FIG. 15 with the 200 series numbers are exclusively related to the functions of the single phase AC to DC Power Conversion block diagram shown as FIGS. 8 & 11 above. Further, the components identified with the 300 series of numbers are exclusively related to the functions performed by the Control Power-Cathode Heating Power Converter (CP/CH PC) shown in FIG. 10 above; still further, the components identified with the 400 series of numbers are exclusively related to the functions of the Arc Current Power Converter in FIG. 9 above. While this preferred embodiment utilizes single phase AC prime power, the Central Power Converter previously described by FIG. 8 could be used and may even be more economically desirable particularly in new construction lighting systems. In the latter case the luminaire's electronic ballast would only include the fluorescent lamp control fraction mainly consisting of the CP/CH PC and the AC PC as illustrated in FIGS. 9 & 10.

The following identifies the components shown is FIG. 15 by their respective reference numbers.

FIG. 15 components

| REF | DESCRIPTION | VALUE/MODEL |
|---|---|---|
| C101 | CAPACITOR | 0.022 μF 630V |
| C102 | CAPACITOR | 0.022 μF 630V |
| C103 | CAPACITOR | 0.047 μF 630V |
| C104 | CAPACITOR | 0.047 μF 630V |
| C105 | CAPACITOR | 100 μF 250VDC |
| C106 | CAPACITOR | 100 μF 250VDC |
| C107 | CAPACITOR | 1 nF 25VDC |
| C108 | CAPACITOR | 0.1 μF 25VDC |
| C109 | CAPACITOR | 10 nF 1KV |
| R101 | RESISTOR | 0.25Ω 2W |
| R102 | RESISTOR | 200KΩ 0.5W |
| R103 | RESISTOR | 200KΩ 0.5W |
| R104 | RESISTOR | 2KΩ 0.25W |
| R105 | RESISTOR | 20KΩ 0.25W |
| R106 | RESISTOR | 200KΩ 0.25W |
| R107 | RESISTOR | 100KΩ 1W |
| R108 | RESISTOR | 100KΩ 1W |
| R109 | RESISTOR | 100KΩ 1W |
| R110 | RESISTOR | 100KΩ 1W |
| R110 | RESISTOR | 150KΩ 1W |
| D101 | DIODE | GI2W06G |

-continued

FIG. 15 components

| | | |
|---|---|---|
| D102 | DIODE | U860 |
| D103 | DIODE | 1N914 |
| D104 | DIODE | TBD |
| D105 | DIODE | 1N2071A |
| F101 | FUSE | 250V 2A |
| Q101 | TRANSISTOR | IRF840 |
| Q102 | TRANSISTOR | IRF840 |
| Q103 | TRANSISTOR | IRF840 |
| L101 | INDUCTOR | UF19225-102Y1R0-02 |
| L102 | INDUCTOR | |
| L103 | INDUCTOR | |
| L104 | INDUCTOR | |
| L105 | INDUCTOR | |
| L106 | INDUCTOR | |
| T101 | TRANSFORMER | |
| T102 | TRANSFORMER | |
| JP101 | TERMINAL BLOCK | MFKDSP/3 |
| JP102 | TERMINAL BLOCK | MFKDSP/3 |
| JP102 | TERMINAL BLOCK | MFKDSP/3 |
| JP102 | TERMINAL BLOCK | MFKDSP/4 |
| C301 | CAPACITOR | 10 μF 25VDC |
| C302 | CAPACITOR | 22 μF 25VDC |
| C303 | CAPACITOR | 0.1 μF 25VDC |
| C304 | CAPACITOR | 0.1 μF 25VDC |
| C305 | CAPACITOR | 47 μF 16VDC |
| R301 | RESISTOR | 470Ω 0.25W |
| R302 | RESISTOR | 10Ω 0.5W |
| R303 | RESISTOR | TBD |
| R304 | RESISTOR | 10Ω 0.5W |
| R305 | RESISTOR | 18KΩ 0.25W |
| VR301 | POTENTIOMETER | 100KΩ |
| D301 | DIODE | 1N2071A |
| D302 | DIODE | 1N4933 |
| D303 | DIODE | 1N4933 |
| IC301 | IC | 3525 |
| IC302 | IC | IR2110 |
| C401 | CAPACITOR | 100 μF 25VDC |
| C402 | CAPACITOR | 47 μF 25VDC |
| C403 | CAPACITOR | 100 pF 25VDC |
| C404 | CAPACITOR | 0.1 μF 25VDC |
| C405 | CAPACITOR | 1.5 nF 25VDC |
| C406 | CAPACITOR | 1 nF 25VDC |
| C407 | CAPACITOR | 1 nF 1KV |
| R401 | RESISTOR | 20KΩ 0.25W |
| R402 | RESISTOR | 3.9KΩ 0.25W |
| R403 | RESISTOR | 470KΩ 1W |
| R404 | RESISTOR | 5.1KΩ 0.25W |
| R405 | RESISTOR | 150KΩ 0.25W |
| R406 | RESISTOR | 47KΩ 1W |
| R407 | RESISTOR | 10KΩ 0.25W |
| R408 | RESISTOR | 10Ω 0.25W |
| R409 | RESISTOR | 20KL2 0.25W |
| R410 | RESISTOR | 1KΩ 0.25W |
| R411 | RESISTOR | 0.5Ω 1W |
| R412 | RESISTOR | 15KΩ 1W |
| VR401 | POTENTIOMETER | 50KΩ |
| D401 | DIODE | 1N4933 |
| D402 | DIODE | 1N4933 |
| D404 | DIODE | 1N2071 |
| IC401 | IC | 3844 |
| Q401 | TRANSISTOR | 2N5657 |
| Q402 | TRANSISTOR | 2N7000 |
| Q403 | TRANSISTOR | MTP3N60E |
| **DREF** | **DESCRIPTION** | **VALUE/MODEL** |
| C201 | CAPACITOR | 0.47 μF 50V |
| C202 | CAPACITOR | 0.1 μF 50V |
| C203 | CAPACITOR | 10 μF 25V |
| C204 | CAPACITOR | 1 nF 25V |
| C205 | CAPACITOR | 270 pF 25V |
| C206 | CAPACITOR | 1 μF 16V |
| C207 | CAPACITOR | 620 pF 25V |
| C208 | CAPACITOR | 47 nF 25V |
| C209 | CAPACITOR | 62 pF 25V |
| C210 | CAPACITOR | 100 μF 25V |

-continued

| FIG. 15 components | | |
|---|---|---|
| R201 | RESISTOR | 1 MΩ 0.5W |
| R202 | RESISTOR | 100KΩ 0.25W |
| A203 | RESISTOR | 27KΩ 0.25W |
| R204 | RESISTOR | 1.3 MΩ 0.5W |
| R205 | RESISTOR | 270KΩ 0.25W |
| R206 | RESISTOR | 75KΩ 0.25W |
| R207 | RESISTOR | 27KΩ 0.25W |
| R208 | RESISTOR | 3.9KΩ 0.25W |
| R209 | RESISTOR | 1.6KΩ 0.25W |
| R210 | RESISTOR | 10Ω 0.25W |
| R211 | RESISTOR | 15Ω 0.25W |
| R212 | RESISTOR | 3.9Ω 0.25W |
| R213 | RESISTOR | 10Ω 0.25W |
| R214 | RESISTOR | 240Ω 0.25W |
| R215 | RESISTOR | 24Ω 0.25W |
| R216 | RESISTOR | 18Ω 0.25W |
| R217 | RESISTOR | 1 MΩ 0.25W |
| D201 | DIODE | 1N5817 |
| IC201 | IC | UC3854N |

What is claimed is:

1. A power conversion and control system for providing variable arc control of a lighting system comprising at least one lamp unit comprising at least one fluorescent gas discharge lamp including electrodes to be heated during the operation of the lamp, said system being powered from a commercial AC power source, and said system comprising means for converting AC power from said AC power source into converted DC power, a first DC to AC power converting means for converting said converted DC power into AC power for providing a variable arc drive for said lamps, sensor means for sensing a parameter related to the arc current flowing in said lamps and for producing a corresponding output, and a second, separate DC to AC power converting means for converting said converted DC power into AC power for supplying said first power converting means and for, responsive to the output of said sensing means, providing, at all times that the lamp is ignited, a heating voltage for said electrodes of a continuously variable value proportional to said parameter such that as the arc current flow decreases, the heating voltage for said electrodes increases.

2. A system as claimed in claim 1, wherein said system has an operating voltage range and said means for converting AC power from said AC power source into converted DC power comprises means for producing a variably controlled DC voltage output independent of variation in the AC voltage produced by said AC power source for heating the electrodes, within said operating voltage range.

3. A system as claimed in claim 1 wherein said first converting means includes switching means for controlling application of said converted DC power to at least one lamp unit, said switching means including first and second oppositely switching electronic switches having conducting and non-conducting states and control means for inhibiting turning on of one switch from the non-conducting state thereof, after the other, previously conducting switch has been turned off, until the voltage on the one switch approaches substantially zero volts.

4. A system as claimed in claim 3, wherein said converter means provides positive and negative DC link voltages and said first and second switches provide alternate application of said positive and negative DC voltages to said at least one lamp unit.

5. A system as claimed in claim 3, wherein said first and second switches comprise field effect transistors.

6. A system as claimed in claim 3, wherein said switching means provides current of a substantially square waveform to said at least one lamp unit.

7. A system as claimed in claim 1, further comprising a protective inductor connected in shunt with said at least one lamp for providing a closed circuit path when said at least one lamp is effectively out of circuit.

8. A system as claimed in claim 7, wherein a current limiting inductance is connected in series with said at least one lamp.

9. A system as claimed in claim 7, wherein said at least one lamp unit comprises a plurality of series lamp-inductor combinations connected in parallel.

10. A system as claimed in claim 1, wherein said system includes means for manually adjusting the light output of said at least one lamp, and light feedback means for sensing the light output of said at least one lamp and for automatically adjusting the output of said at least one lamp in accordance with the sensed light output of said at least one lamp.

11. A power conversion and control system for providing variable arc control of a lighting system comprising at least one lamp unit comprising at least one fluorescent gas discharge lamp, said system comprising converter means for converting AC power from an AC source into DC power and switching means for controlling application of said DC power to at least one lamp unit, said switching means including first and second oppositely switching electronic switches having conducting and non-conducting states and control means for inhibiting turning on of one switch from the non-conducting state thereof, after the other, previously conducting switch has been turned off, until the voltage on the one switch approaches substantially zero volts, said system further comprising a protect inductor connected in shunt with said at least one lamp for providing a closed circuit path when said at least one lamp is effectively out of circuit so that stored energy is discharged thereby protecting said electronic switches.

12. A system as claimed in claim 11, wherein said converter means provides positive and negative DC link voltages and said first and second switches provide alternate application of said positive and negative DC voltages to said at least one lamp unit.

13. A system as claimed in claim 11, wherein said first and second switches comprise field effect transistors.

14. A system as claimed in claim 11, wherein said switching means provides current of a non-sinusoid, substantially square waveform to said at least one lamp unit.

15. A system as claimed in claim 11, wherein a current limiting inductance is connected in series with said at least one lamp.

16. A system as claimed in claim 11, wherein said at least one lamp unit comprises a plurality of series lamp-inductor combinations connected in parallel.

17. A system as claimed in claim 11, wherein said system includes means for manually adjusting the light output of said at least one lamp, and light feedback means for sensing the light output of said at least one lamp and for automatically adjusting the output of said at least one lamp in accordance with the sensed light output of said at least one lamp.

* * * * *